United States Patent [19]

Geiger

[11] 4,365,777

[45] Dec. 28, 1982

[54] TRAIN APPROACH DETECTOR

[75] Inventor: Willard L. Geiger, Chagrin Falls, Ohio

[73] Assignee: Modern Industries Signal Equipment, Inc., Cleveland, Ohio

[21] Appl. No.: 67,321

[22] Filed: Aug. 17, 1979

[51] Int. Cl.³ ..... B61L 1/02; B61L 1/12; B61L 21/06

[52] U.S. Cl. ..... 246/130; 246/34 CT; 246/125; 246/128; 307/260; 324/76 R; 330/107

[58] Field of Search ..... 246/34 R, 34 CT, 34 C, 246/122 R, 114 R, 125, 121, 130, 128, 28 C, 28 F, 187 C, 40

[56] References Cited

U.S. PATENT DOCUMENTS

| | | | |
|---|---|---|---|
| 3,246,143 | 4/1966 | Steele et al. | 246/128 |
| 3,614,418 | 10/1971 | Pell | 246/128 |
| 3,619,604 | 11/1971 | Auer et al. | 246/125 |
| 3,706,098 | 12/1972 | Geiger | 246/40 |
| 3,740,550 | 6/1973 | Geiger | 246/125 |
| 3,777,139 | 12/1973 | Peel | 246/125 |
| 3,781,541 | 12/1973 | Darrow et al. | 246/125 |
| 3,820,100 | 6/1974 | Ballinger et al. | 246/249 |
| 3,838,270 | 9/1974 | Ballinger et al. | 246/130 |
| 3,850,390 | 11/1974 | Geiger | 246/128 |
| 3,929,307 | 12/1975 | Geiger | 246/130 |
| 3,944,173 | 3/1976 | Moe et al. | 246/34 CT |
| 3,974,991 | 8/1976 | Geiger | 246/125 |
| 3,977,634 | 8/1976 | Smith | 246/128 |
| 3,987,989 | 10/1976 | Geiger | 246/34 R |
| 4,172,576 | 10/1979 | Svet et al. | 246/128 |

*Primary Examiner*—James J. Groody
*Attorney, Agent, or Firm*—Maky, Renner, Otto & Boisselle

[57] ABSTRACT

A train approach detector uses frequencies in the audio spectrum to activate grade crossing protection devices in advance of and during the presence of railroad trains at grade crossings. The detector is completely solid state, and includes one transmitter and one receiver each connected to the tracks so that transmitted and received track signals, which are partially pulse modulated for optimum filtering and signal coupling and minimum third harmonic radiation, appear on opposite sides of the crossing. The section of track between the transmitter and receiver is designated as a crossing island and sections of rail outside of the island are known as approaches. In addition to its basic train movement detection function, the detector contains additional features that are designed to provide operation under a variety of application conditions, including automatic ballast compensation, loss of shunt, low signal/low gain condition, high signal/broken rail condition, delayed pick-up, delayed drop-out and reverse switch override, and bi-directional motion detection.

88 Claims, 7 Drawing Figures

TRAIN APPROACH DETECTOR

TECHNICAL FIELD

The present invention relates to train approach detectors and, more particularly, to improvements in the same for detecting a vehicle on a track, for monitoring certain conditions of the track, for self-correcting for variations in track ballast, and for self-checking operative condition of the apparatus.

BACKGROUND OF PRIOR ART

Two types of prior train approach detectors include those which respond to the presence of a train or other vehicle on a track without being sensitive to the speed at which the train is approaching the tie points of the detector to the track and, of course, those of the type which do respond to the train approach speed. The former type may simply include a section of track that is electrically insulated from adjacent portions of the track and a detector which detects electrical coupling of the rails of the insulated section through the wheels and axle, for example, of a train present thereon. The latter type have included so-called predictors, which upon detecting an approaching train at a particular location on a track predict the time of arrival at a protected area, i.e. the island, and movement detectors, which monitor the approaching train speed and distance from the island and, for example, drop a crossing gate prior to arrival of the train at a grade crossing in the island.

A variety of problems have been encountered with prior train approach detectors. For example, the track ballast condition, i.e. the lumped impedance seen by the detector, may vary widely with daily and seasonal weather changes often creating imbalances in the track signal monitored by the detector and, therefore, requiring frequent attention of a service person to adjust signal levels. Another problem experienced in the past has been distortion of the track signal by third harmonic radiation and entry into the detector of spurious signals. Moreover, the installing and servicing of prior train approach detectors have been relatively complicated, time consuming and, accordingly, expensive. Other specialized problems also have been encountered with the various prior train approach detectors.

BRIEF SUMMARY OF THE INVENTION

The present invention is directed to a train approach detector (hereinafter "detector") which minimizes or eliminates one or more of the aforesaid and other problems experienced by prior detectors. The detector has high sensitivity, for example due to automatic signal correction that maintains the track signal at an optimum level for train detection, and is thus also not usually subject to false alarms. The detector of the invention includes a transmitter for transmitting a track signal and a receiver for receiving the track signal and producing output information indicative, for example, of whether or not a train is detected. As used herein "train" means a vehicle on a track and preferably a vehicle or other device that shunts the rails of a track. Typically the transmitter and receiver are connected at respective spaced-apart tie points to the rails of the track thereby defining an island between the tie points at which the transmitter is connected and those at which the receiver is connected. In many instances a grade crossing is located within the island and the output information produced by the detector is in the form of an output signal which picks up or drops a relay that controls a grade crossing protection device, such as a crossing gate, a warning light or the like usually to indicate when a train is near and approaching the grade crossing. Such output information, then, may be referred to below as dropping or picking up of a crossing gate. The detector also monitors certain conditions of the track, such as the condition of the ballast and of the rails, say to detect a broken rail, and is self-checking to confirm satisfactory operative condition of the various portions thereof. In the event of an unsatisfactory condition of the ballast, track or portion of the detector, the latter preferably produces the output information mentioned above, e.g. the crossing gate is dropped, thereby requiring the service person to check, to reset, and/or to repair the track and/or the detector to enable the detector to pick up the crossing gate.

According to the preferred embodiment and best mode the detector of the invention has its transmitter and receiver connected at spaced-apart tie points to a track, defining an island therebetween, and the detector is used to detect a train within an approach on one side of the island or approaches on both sides of the island. Each such approach ordinarily is defined as the length of track between the island and a remote, say several hundred to several thousand feet away from the island, beginning of approach shunt, which may be of the hard wire type that connects all signals between the rails, the broad band type that connects nearly all AC signals between the rails and blocks DC signals, such as DC code, or the tuned type tuned primarily to connect between the rails exclusively the AC track signal developed in the transmitter. However, it will be appreciated that the train approach detector of the invention may be used in certain instances without specifically defining such approaches, i.e. without using such shunts, and may be used not only for grade crossing protection but also in connection with block signalling and control techniques, automatic train and/or track control techniques, and so on. Also, various features of the invention, as will become apparent from the following description, may be used in systems other than train approach detectors.

Several features of the invention are noted in the following summary; however, these and other features of the invention are described in greater detail in the specification, are illustrated in the drawings, and are particularly pointed out and distinctly claimed in the claims.

The transmitter delivers an AC track signal to the track through a filter. The AC track signal is developed from an AC input signal preferably in the audio frequency spectrum that is split or divided into two divided signals having a common frequency and phase relation. One of the divided signals is modulated at a modulation frequency lower than such common frequency, and the modulated divided signal and the unmodulated divided signal then are combined to produce the AC track signal with a partially modulated character such that it is not modulated to zero at the modulation frequency. It has been discovered that the transmitter and receiver filters will have a high operational efficiency since the track signal is not modulated to zero at the modulation frequency and that there will be a minimum of third harmonic radiation in the track signal. In the receiver a distance voltage ($E_D$) is produced at an amplitude directly proportional to that of the received AC track signal. Moreover, an automatic level control operates to adjust the effective magnitude of the track signal to maintain the $E_D$ voltage substantially constant over relatively wide variations in the track ballast conditions; however, such control is effected with a relatively long time constant to avoid level correction in response to track signal variations caused by an approaching train. Such level control preferably effects gain control in both the receiver and the transmitter in response to the magnitude of the track signal received by the receiver and the gain of the latter. A high signal detector senses excursions of the track signal beyond a high signal level due, for example, to an extreme uncompensatable ballast condition or a broken rail, and a high signal latch provides a long term indication that such high signal level occurred even after the condition has abated. A voltage clamp limits the rise of the $E_D$ voltage for a predetermined duration when a train leaves the island and the track signal begins climbing again. A low signal detector detects excursions of the track signal below a low signal level. The settings of the low and high signal levels, then, define a voltage window in which the track signal voltage ordinarily is expected to be found unless a train is present at a certain location in an approach or a track or ballast condition occurs that is not compensatable by the level control. The low signal detector both provides a back-up to the motion detecting portion of the receiver to assure that the desired output information indicative of a train is produced when the train is a predetermined distance from the island, regardless of its approach speed, and holds constant the automatic level adjustment circuitry to avoid overdriving the transmitter and receiver when the low signal point is reached. A low signal bypass circuit bypasses the effect of the low signal detector when the motion of an approaching train has been detected before the low signal point has been reached. A delayed pick-up circuit delays picking up the crossing gate, i.e. termination of output information indicative of an approaching train, for a predetermined duration after the motion of an approaching train has been detected and temporarily lost, say due to the leading wheels passing across a rusty rail. Other features include substantial self-checking of both the transmitter and the receiver to assure that an inoperative detector will not permit an approaching train to pass through the island without a warning, internal metering equipment to facilitate installation and servicing of the detector, and delayed drop out or reverse switch override compensating circuitry to permit a switch in an approach to be thrown to allow a train to enter a monitored approach traveling in a receding direction from the island without dropping the crossing gate. Also, an initialization circuit and the level control circuitry facilitate installation of the train approach detector which in many instances may simply be coupled to respective tie points to the track, powered up, and allowed to operate without further adjustment. Further, an improved output circuit assures the accuracy of the output information produced in response to the several parameters and conditions monitored by the detector.

A primary object of the invention is to provide an improved train approach detector.

Another object is to facilitate installation of the train approach detector.

Another object is to provide automatic level control in a train approach detector.

Another object is to develop a highly accurate filtered AC signal.

Another object is to provide in a train approach detector one or more of the following capabilities: motion detection to detect the approaching motion of a train, island protection to detect the presence of a train in an island, low signal detection, low signal bypass, high signal detection, loss of shunt protection, output signal integrity, reverse switch override temporary disabling to avoid nuisance of unnecesssary crossing gate down time, thorough self-checking capability, internal voltage clamp operative when a train leaves an island, and a high signal indicator to indicate that a high signal condition had existed and may still exist.

These and other objects and advantages of the features of the present invention will become more apparent from the detailed description of the invention below.

In accordance with the preferred embodiment and best mode of the invention, which is illustrated in the drawings and described in detail, the train approach detector includes a transmitter and receiver connected at respective spaced-apart tie points to a track so as to define an island therebetween. Beginning of approach shunts preferably are placed at locations remote from the island, say usually at several thousand feet away from the respective tie points to define respective approaches to the island, tie points, or detector. The transmitter produces an AC track signal, which preferably is transmitted in the track, and the receiver receives the track signal. Moreover, in the receiver a motion detector, island detector, high and low signal detectors, low signal bypass circuit and output circuit respond to the received track signal to produce output information in dependence on such track signal. The output information preferably is an on or off signal picking up or dropping a relay which controls pick-up or dropping, respectively, of a crossing gate or the like. Thus, the detector will cause, say, a crossing gate to drop upon detecting an approaching train and also will cause the crossing gate to drop, for example, when a high or low signal condition exists or a failure occurs in the detector itself causing a slight inconvenience to automotive traffic, for example, trying to pass over a grade crossing but more importantly causing the prompt attention of a service person to check the detector and the monitored track to determine the reason for the down crossing gate when no train has been detected.

To the accomplishment of the foregoing and related ends, the invention, then, comprises the features hereinafter fully described in the specification and particularly pointed out in the claims, the following description and the annexed drawings setting forth in detail a certain illustrative embodiment of the invention, this being indicative, however, of but one of the various ways in which the principles of the invention may be employed.

DETAILED DESCRIPTION OF INVENTION

Figure 1:
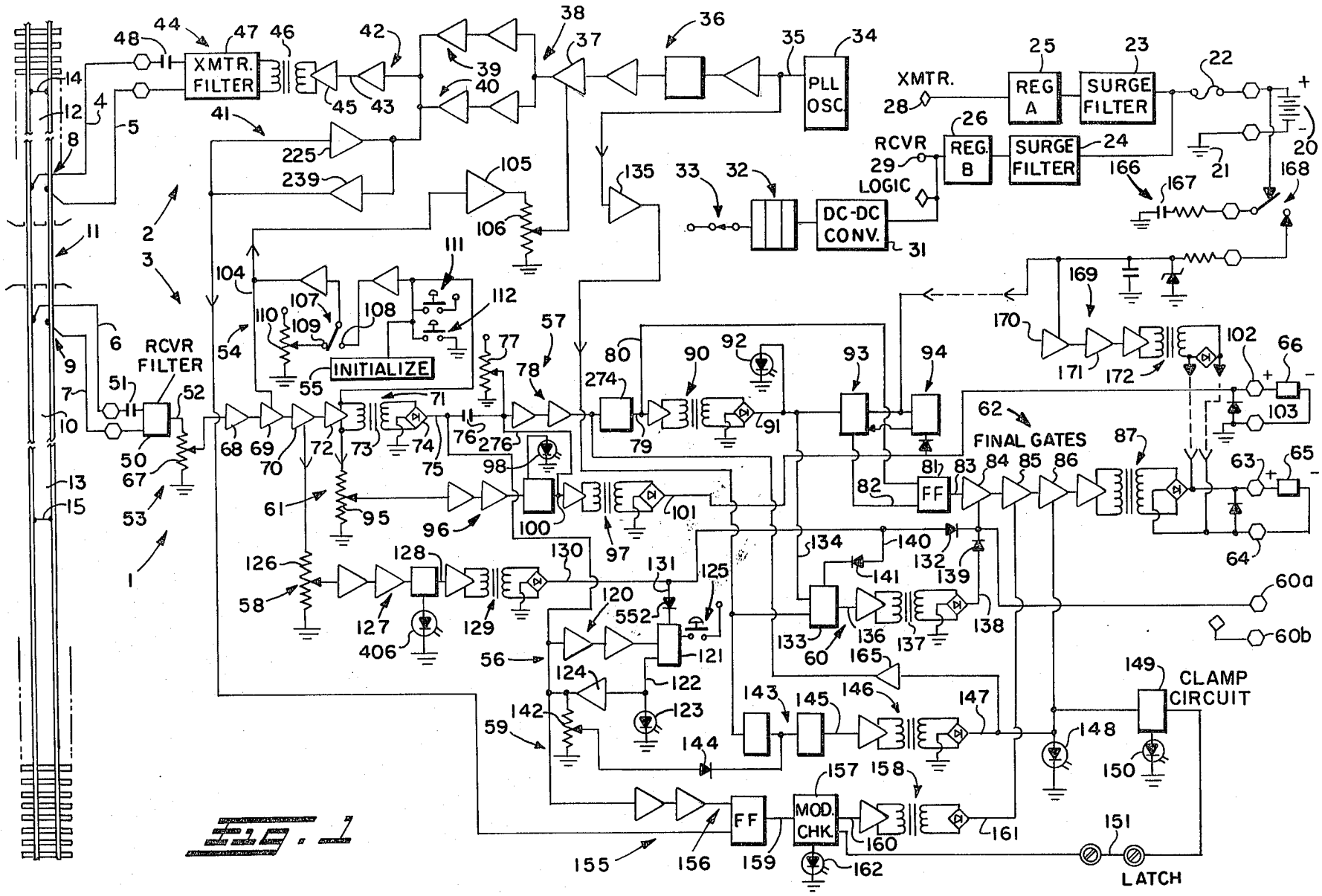
FIG. 1 is a schematic system diagram illustrating the train approach detector of the invention coupled to a railroad track.

Referring now in detail to the drawings, wherein like reference numerals designate like parts in the several figures, and initially to FIG. 1, a train approach detector in accordance with the invention is illustrated at 1. The detector 1 includes a transmitter 2, which develops an AC track signal, and a receiver 3, which receives and monitors the track signal. The transmitter and receiver are connected by leads 4–7, respectively, at respective tie points 8, 9 to the parallel rails of a typical railroad track 10. It is conceivable and within the concept of the present invention that the transmitter and receiver not be electrically connected to the track; for example, the track signal may be a radio wave that is attenuated by an approaching train. An island 11 on the track 10 is defined between the tie points 8, 9 and typically will have located therein a conventional grade crossing at which highway and/or pedestrian traffic may cross the track. It is a primary function of the detector 1 to operate a crossing gate, not shown, to signal traffic near the grade crossing of a train approaching or occupying the same. The output information produced by the detector 1 may be used not only to operate such a warning indicator but also to provide information to a remote system, such as a computer, concerning the location of a train or other vehicle on the track 10 for information purposes and/or for control purposes, such as block control. As described below, the detector 1 is presented in its preferred embodiment for effecting the noted protection of an island 11 and to that end is operative normally to detect the presence of a train in the island 11 or approaching the same and within one of the monitored approaches 12, 13 thereto. The length of such approach is usually several thousand feet, and the beginning of each approach normally is determined by the location of a shunt 14, 15 across the rails of the track 10, such shunt being either of the hard wire, broad band or tuned type mentioned above.

Electrical power for the detector 1 is developed from a DC battery 20, which is connected between a relative ground terminal 21 and a fuse 22. The battery power supplied through the fuse 22 is provided to conventional surge filters 23, 24 and to conventional regulators 25, 26, which in turn provide DC voltage to various portions of the detector 1, for example, by connections made between the several diamond shape terminals 28 or circle shape terminals 29. The regulator 26 also supplies power via a DC to DC converter 31, which provides isolation and avoids substantial loading of regulator 26, to a conventional liquid crystal display meter 32, which may be selectively connected by a multiple pole switch 33 to various test points in the detector 1 to monitor and to display the magnitudes of signals occurring at such test points. The meter 32 preferably is a built-in one to facilitate checking such signals in the detector 1 without the need for a service person to carry peripheral metering equipment and to connect such equipment to selected test points in the detector 1.

To develop the AC track signal, the transmitter includes an AC input signal generator 34, which provides on line 35 an AC input signal having a frequency selected according to the length of the approach or approaches to be monitored and the frequency of other signals in the track; a wave shaping and amplifying circuit 36, which preferably shapes the AC input signal to a sine wave; an automatic gain control amplifier circuit 37, which controls the magnitude of the sine wave AC input signal; a splitter circuit 38, which includes two separate amplifier channels 39, 40 to divide or split the AC input signal; a modulating circuit 41, which modulates one of the divided sine AC input signals at a frequency lower than that of the AC input signal; a buffer amplifier summing junction 42, which combines the unmodulated divided sine AC input signal with the modulated one to provide on line 43 a sine wave signal at one frequency partially modulated at the lower modulation frequency of the modulating circuit 41; and a track signal input circuit 44. The input circuit 44 includes a driver amplifier 45, an isolating coupling transformer 46, and a filter 47, such as a four pole filter, which provides the partially modulated AC track signal via a further DC signal blocking capacitor 48 and leads 4, 5 to the track 10.

The manner in which the signal provided on line 43 is developed will be described in greater detail below with reference to FIG. 2. However, it will be appreciated that such signal is a partially modulated sine wave; partial modulation means that the modulated sine wave on line 43 is not modulated to zero at the modulation frequency of the modulating circuit 41. Rather, the sine wave signal on line 43 goes through zero primarily only according to the frequency of the AC input signal produced by the input signal generator 34. It has been discovered that by providing such a partially modulated signal to the transmitter filter 47, the latter will operate at high efficiency resulting in minimum third harmonic radiation in the AC track signal. The minimum pulse height of the individual pulses of the input signal to the transmitter filter 47, i.e. because the modulation provided only is a partial one, assures that the filter always is operational, i.e. it is not fully operational and de-operational at the modulation frequency, which would occur if the signal on line 43 were a fully modulated one. It has been found that a good filter will respond in its filtering action better to changes in amplitude than to deletion and restart-up, i.e. as the signal goes through zero at a modulation frequency, of the signal provided thereto. Accordingly, the transmitter filter 47 in combination with the partially modulated signal input thereto may be a four pole filter having, for example, a 35 db signal rejection for adjacent channel separation. Similar advantages inure to the receiver filter 50 which filters the received track signal from leads 6, 7 and blocking capacitor 51 and provides such filtered received track signal on line 52 of the receiver 3.

The various portions of the receiver 3 include an input circuit 53, level control circuit 54, initialize circuit 55, voltage clamping circuit 56, motion detecting circuit 57, low signal detector circuit 58, high signal detector circuit 59, low signal detector bypass circuit 60, island detector circuit 61 and output control circuit 62. The detector 1 produces via the output control circuit 62 output information at output terminals 63, 64 indicating, for example, whether or not a train has been detected by the detector 1. For example, a positive DC signal across the output terminals 63, 64 may indicate that the detector 1 is properly operating and no train has been detected and such signal may energize a detector relay 65, which in turn operates a conventional crossing gate to pick up the same at the island 11 allowing traffic to move unimpeded through the grade crossing there. Thus, the output from the relay 65 or the effect caused thereby may be considered the output information of the detector 1. Alternatively, the removal of the positive DC signal from the output terminals 63, 64 will deenergize the relay 65, which in turn allows the crossing gate to drop thereby warning traffic of an approaching train. The detector 1 also is self-checking and effects the latter type of output upon encountering a failure in itself, thus requiring a service person to check the detector 1 and/or the monitored track and to correct any problems. Since the detector 1 causes the desired output information of, say, dropping the crossing gate upon detecting a failure in itself, such failure, then, will in effect be in a safe direction so that traffic will be impeded at the then possibly unprotected grade crossing causing automatic additional caution by drivers. The output control circuit 62 also may include an island relay 66, which in effect may be redundant to the detector relay 65 in being operative to produce output information, to lock out the crossing gate in a dropped condition, when a train is in the island 11.

The input circuit 53 includes a master gain adjusting potentiometer 67 coupled to the output line 52 of the receiver filter 50, a buffer amplifier 68 for receiving the track signal from the potentiometer 67 and providing amplification and isolation, a receiver automatic gain control amplifier 69, a further buffer amplifier stage 70 for signal amplifying and isolation purposes, and a signal conversion circuit 71. The signal conversion circuit 71 is typical of other similarly illustrated signal conversion circuits in the receiver 3; such circuit has as its purpose the conversion of a received AC signal to a substantially DC signal and to that end includes a driver amplifier 72, a transformer 73, and a full wave rectifier 74. The DC signal produced on line or junction 75 at the output of the signal conversion circuit 71 is the distance voltage $E_D$ of the detector 1. The distance voltage will vary according to the track ballast condition and the gains of the transmitter and receiver, which are controlled by the level control circuit 54 in an effort to try to maintain the $E_D$ voltage substantially constant at, for example, 40 volts.

The $E_D$ voltage also will vary in response to shunting of the rails of the track 10 by a train in an approach. It is the purpose of the motion detecting circuit 57, which includes a capacitor 76, sensitivity adjusting potentiometer 77, and wave shaping and amplifying circuit 78, to monitor downward changes in the $E_D$ voltage; when the rate of such downward change exceeds a predetermined value, for example to override the effect of a comparison signal received by the motion detecting circuit, the motion detector output signal provided on line 79 reflects the same as an indication of detection of motion of an approaching train.

The motion detector output signal is delivered via line 80 to a flip-flop circuit 81 in the output control circuit 62. Ordinarily such motion detector output signal will be an AC signal when motion has not been detected and will be a DC signal level when motion has been detected. The AC motion detector output signal causes the flip-flop 81, when it is enabled by an enabling signal on line 82, to produce an AC square wave signal at its output 83.

The output control circuit 62 also includes a plurality of gates 84–86 which are operative in response to proper operation of various internally monitored or checked portions of the detector 1 to pass the AC square wave signal to a signal conversion circuit 87 that provides the output information across the output terminals 63, 64. When motion has been detected by the motion detecting circuit 57, a DC motion detector output signal on line 80 prevents the flip-flop 81 from producing the AC square wave signal thereby terminating the production of a zero DC output signal (the output information) across output terminals 63, 64, which would de-energize the relay 65 to drop the crossing gate. The effective disabling of any of the output gates 84–86 in response to a detected high or low signal condition or a failure in the detector 1 also will block the AC square wave signal from reaching the signal conversion circuit 87 and, therefore, effects a zero output signal across the output terminals 63, 64.

Also in the motion detecting circuit 57 is a signal conversion circuit 90 which provides a positive DC signal voltage on line 91 when no motion has been detected and a zero value on line 91 when motion has been detected. Line 91 is connected to a light emitting diode 92, which signals by not emitting or emitting light, respectively, whether or not motion has been detected. Line 91 also is connected via a delayed pick-up timer circuit 93 and line 82 to provide an enabling signal to the flip-flop 81 and to eliminate such enabling signal when motion has been detected, thus assuring that the flip-flop 81 will not produce the AC square wave signal then. The delayed pick-up timer (DPU) circuit 93 is operative for approximately ten seconds each time motion has been detected and lost to prevent delivering an enabling signal to line 82 for such timed duration. A DPU cancel circuit 94 also is connected to the timer 93.

The island detector 61 both senses whether a train is in the island and provides the needed comparison signal for the motion detecting circuit, and it includes a potentiometer 95 connected to the input circuit 53 to receive the track signal or at least a signal proportional thereto, a wave shaping and amplifying circuit 96, a signal conversion circuit 97, and a light emitting diode island indicator 98. The potentiometer 95 may be adjusted to control the gain or sensitivity of the island detector 61. When there is no train in the island 11, an AC signal picked off from the potentiometer 95 is amplified and shaped and provided as an AC signal on line 100 for conversion to a DC signal level provided by the signal conversion circuit 97 on line 101. A pulsing light output from the light emitting diode 98 provides a visual indication in the casing, not shown, of the detector 1 that no train is in the island and that the island detector 61 is operating properly. However, when the wheels of a train shunt the track rails in the island 11, any AC signal, i.e. if there is one, that may be picked off from the potentiometer 95 by the circuit 96 will be inadequate to cause the latter to produce an AC signal on line 100 so that the voltage on line 101 will drop to zero. Line 101, moreover, is connected, on the one hand, to one of the island output terminals 102, 103, across which the island relay 66 is connected, and, on the other hand, to the delayed pick-up timer 94. Therefore, when a train is in the island and a zero signal is produced on line 101, the island relay 66 will be dropped or deenergized to assure that the crossing gate at the island 11 will be down. The zero signal on line 101 acts as a priming signal to prepare the cancel circuit 94 for the delayed pick-up timer 93 for operation so that promptly after the train leaves the island 11 the timer 93 will not disable the flip-flop 81; rather, relatively promptly after the train leaves the island the island detector 61 produces a signal on line 101 to energize or pick up the island relay 66 and to operate the cancel circuit to cancel any time left on the delayed pick-up timer 93 and the motion detecting circuit 57 produces an AC motion detector output signal on line 79 to effect enabling of the flip-flop 81 and to cause the latter to produce an AC square wave signal which in turn will energize or pick up the movement detector relay 65. Therefore, the detector 1 will have a minimum ring by time.

The level control circuit 54 monitors the $E_D$ voltage at line 75 and produces a gain controlling signal on line 104, which is connected to the receiver automatic gain control amplifier 69 and via an amplifying and isolating buffer amplifier 105 and potentiometer 106 to the transmitter automatic gain control amplifier 37. In trying to maintain the magnitude of the $E_D$ voltage substantially constant the level control circuit 54 varies the gain control signal on line 104 to obtain corresponding variations in the gains of the amplifiers 37, 69. Ordinarily the gain response in the transmitter to changes in the gain control signal will be severalfold, say two to four and preferably three times, greater than the gain response in the receiver in order to avoid overdriving the receiver. The potentiometer 106 may be adjusted to set the basic gain of the transmitter which then can be varied according to the gain control signal on line 104. A switch 107 associated with the level control circuit 54 is adjustable between automatic and manual terminals 108, 109, the latter of which is connected to a potentiometer 110. The manual mode of operation selected by the switch 107 is used when there is no desire to compensate for changes in the lumped impedance, whereas automatic mode of operation enables automatic compensation for a wide variation in lumped impedance and also facilitates prompt installation and set up of the detector 1 with a minimum of adjustments.

When the switch 107 is in the automatic position connecting with terminal 108, the level control circuit 54 is operative in an automatic mode continuously to adjust the gains in the transmitter and receiver in an effort to try to maintain the magnitude of the $E_D$ voltage at line 75 substantially constant while the track current varies according to variations in the lumped impedance of the track ballast; the lumped impedance is that effectively seen by the detector 1. Alternatively, in a manual mode with the switch 107 connected to terminal 109 the gain control signal on line 104 will remain constant at a level set by the manual gain adjusting potentiometer 110. The track current, then, will remain substantially constant over a wide range of lumped impedance or ballast variations while the $E_D$ voltage may vary from, for example, about 50% greater or less than its normal maximum level and perhaps even to a lower level when the lumped impedance becomes extremely small.

When the switch 107 is in the manual mode, the operational window between low and high signal levels will be limited to approximately 25 volts, e.g. between 25 and 50 volts, beyond which the crossing gate will be dropped and track power and receiver gain must usually be adjusted for seasonal changes since the lumped impedance and particularly the track ballast will vary widely with temperature and weather conditions. On the other hand, when the switch 107 is in the automatic position for operation of the detector 1 in an automatic mode the level control circuit 54, which preferably includes a relatively slow integrator, will monitor and compensate for variations causing changes in the $E_D$ voltage over approximately a 15 minute correction cycle. Such correction effectively increases in many instances to more than double the effective operational window of the detector 1. The slow correction provided by the level control circuit 54 will not significantly affect the changes in $E_D$ voltage due to an approaching train. For testing or other purposes, it may be desired to increase the speed at which the level control circuit 54 effects its corrective function and for that purpose selectively operable down and up correcting switches 111, 112 may be used to decrease or to increase the $E_D$ voltage in a rather short time. Moreover, the initialize circuit 55 is connected to the level control circuit 54 to assure that the latter causes a relative maximum gain control signal to minimize the time required for the $E_D$ voltage to come up to its normal level when the detector 1 is powered up.

The voltage clamping circuit 56 includes a receding movement detector 120 which monitors the $E_D$ voltage and starts a clamp timer 121 when receding movement of the train is detected, i.e. the $E_D$ voltage starts climbing. The clamp timer 121 produces an output on line 122, then, to energize a light emitting diode 123, which indicates that the clamp timer is operative for its timed duration of, for example, seven to ten minutes, and the signal on line 122 also is delivered to a clamp circuit 124, which limits the maximum rise or magnitude of the $E_D$ voltage while energized by the timer 121. To facilitate checking and servicing the detector 1, a clamp cancel switch 125 may be selectively closed by a service person to cancel any time left on the clamp timer 121, thus precluding further operation of the clamp circuit 124.

The voltage clamping circuit is particularly useful when a train in an approach approaches an island and stops before its motion has been detected and, particularly, before the track signal has dropped below the low signal level or when a receding train reaches the location on the track at which the track signal just exceeds the low signal level, i.e. the low signal track location. While such receding train proceeds or stopped train waits, the level control circuit 54 will increase the transmitter and receiver gains to bring the $E_D$ voltage back up to its desired optimum level of, say, 40 volts. If the stopped train then recedes, for example, the $E_D$ voltage will climb, due to the increased ballast and the high gains to a high level that may cause a high signal condition to occur. The same is true when a receding train passes the low signal track location. The voltage clamping circuit 56 limits the maximum voltage while such train recedes to avoid high signal detection. Moreover, the voltage clamping circuit provides still an added check on the operation of the detector 1, particularly the ability of the latter to sense receding motion; for if receding motion cannot be sensed, the high signal condition may occur and cause dropping of the crossing gate.

In the low signal detector 58 a low signal adjusting potentiometer 126 is adjustable to set the low signal level, i.e. the effective minimum magnitude of the track signal below which a low signal condition is sensed. The low signal detector 58 includes an amplifying and threshold detecting circuit 127 which receives the signal from the potentiometer 126 and delivers an AC signal at output 128 when the track signal exceeds the low signal level. The detector 58 also includes a signal conversion circuit 129 that provides a positive or zero DC signal on line 30 depending on whether the track signal is above or below the low signal level. Line 130 is connected by line 131 to the clamp timer 121 to disable the same whenever a low signal level has been sensed by the low signal detector 58. Line 130 also is connected via an isolating diode 132 to the low signal gate 84 in the output control circuit 62 ordinarily to disable such gate from passing the AC square wave signal received on line 83 from flip-flop 81 when a low signal level is sensed by the detector 58.

The low signal detector bypass circuit 60 overrides the disabling effect of the low signal detector when the latter senses a low signal level if motion is detected by the motion detecting circuit 57 before the low signal level is reached. The bypass circuit 60 includes a low signal bypass amplifier 133, which monitors the DC signal on line 91 via line 134 and also receives a checking pulse train from the input signal generator 34 and isolating buffer amplifier 135 indicating operation of the input signal generator. The amplifier 133 becomes enabled to provide an AC signal on line 136 whenever the motion detecting circuit 57 detects motion and the checking pulse train is received. A signal conversion circuit 137 converts such AC signal to a positive DC voltage on line 138, and such voltage is provided via an isolating diode 139 to the low signal gate 84 to maintain the same enabled even after the voltage on line 130 from the low signal detector 58 drops to zero. A control signal from line 140 and isolating diode 141, which are connected to the output line 130 of the low signal detector 58 will disable the low signal bypass amplifier 133 from producing the AC signal on line 136 when a low signal level has been sensed by the low signal detector 58 before motion has been detected by the motion detecting circuit 57. By providing a jumper across terminals 60*a*, 60*b* a permanent signal is provided to continuously enable the gate 84 and, therefore, effectively to disable the effect of the low signal detector 58 on the output control circuit 62. This disabling may be effected automatically, say by a remote electrical switch, when a track switch in the monitored approach is thrown and causes a low signal condition to be sensed by the low signal detector 58. Although so disabled in its function to control the output control circuit 62, the low signal detector still is operative both to cancel the voltage clamping circuit clamp timer 121 and to disable the low signal detector bypass circuit 60.

A high signal level adjusting potentiometer 142 at the input to the high signal detector 59 receives the $E_D$ voltage and is adjustable to set the high signal level, i.e. the maximum magnitude of the $E_D$ voltage and, thus, the track signal, above which a high signal level is sensed. The high signal detector 59 also includes a signal isolating and threshold detector circuit 143 which receives the checking pulse train from AC input signal generator 34 and buffer amplifier 135 and also receives via isolating diode 144 that portion of the $E_D$ voltage selected by the potentiometer 142. When the checking pulse train is received by the circuit 143 and the $E_D$ voltage is below the high signal level, an AC signal will be produced at output line 145 of circuit 143 to provide via signal conversion circuit 146 a positive DC voltage on line 147. The positive voltage on line 147 energizes a light emitting diode 148, which indicates satisfactory operation of the AC input signal generator 34 and high signal detector 59 and that a high signal level is not being sensed, and such positive voltage also is delivered to the high signal gate 86 enabling operation of the same to pass the AC square wave signal received from the flip-flop 81 via the other gates 84, 85. When either the checking pulse train terminates or a high signal level is sensed, no AC signal will be produced by the circuit 143 on line 145 so that a zero voltage will appear on line 147 extinguishing the diode 148 and causing the gate 86 to block any received AC square wave signal. A high signal clamp circuit 149 responds to a zero voltage on line 147, which normally signifies the sensing of the high signal level, to energize a light emitting diode 150. The clamp circuit 149 maintains the diode 150 energized to emit light even after the high signal condition has terminated so that a service person later checking the detector 1 can see that a high signal condition has occurred in the past. Such a high signal condition may have indicated a broken rail in an approach, and, therefore, the service person would normally check the approaches to confirm the integrity of the rails after seeing the energized diode 150. The high signal clamp circuit 149 may be connected by a jumper 151 to maintain the high signal gate disabled and the crossing gate down even after the high signal condition has abated and until the detector 1 is reset by a service person.

A modulation checking circuit 155 which both checks operation of the modulating circuit 41 and additionally confirms that a high signal level is not occurring includes an amplifying, isolating and mixing circuit 156, a signal squarer, such as a threshold detector or flip-flop, 157, and signal conversion circuit 158. The circuit 156 amplifies any ripple pulses in the $E_D$ voltage and in response to receiving such amplified pulses and a modulation check signal, which verifies proper operation of the modulating circuit 41, produces an AC signal on line 159; if such ripple pulses are not received or if the modulation check signals are not received, a steady state DC voltage will appear on line 159. Responding to the AC signal on line 159, the signal squarer 157 produces a square wave on line 160 that is converted to a positive DC voltage on line 161 by the signal conversion circuit 158 to enable operation of the high signal and modulation checking gate 85 in the output control circuit 62 to pass any received AC square wave signal developed in the flip-flop 81. A light emitting diode 162 connected to the signal squarer 157 will be pulsed at the same frequency as the AC signal appearing on line 159. A steady state DC signal on line 159, though, will result in a zero voltage on line 161 preventing the gate 85 from passing an AC square wave signal. Moreover, with the jumper 151 in place, the sensing of the high signal level by the high signal detector 59 operates through the high signal clamp circuit 149 to bias or to disable the signal squarer 157 to prevent its producing a square wave on line 160 so that the clamp circuit 149 maintains the gate 85 disabled until the clamp circuit 149 is reset.

A high signal delayed pick-up initiate amplifier circuit 165 responds to production of a zero voltage on line 147, e.g. in response to a high signal detection by the high signal detector 59, to cause the delayed pick-up timer 93 to effect dropping of the crossing gate and to maintain the same dropped until the timer 93 times out. This operation avoids pick-up and dropping of the crossing gate when the track signal and particularly the $E_D$ voltage is hovering about the high signal level and allows stabilization of such signals without such intermittent pick-up and dropping of the crossing gate.

A reverse switch override (RSO) control circuit 166 includes a capacitor 167 normally charged through a switch 168, which is coupled to a battery power supply, such as battery 20 and an RSO power circuit with its own oscillator 170. When a track switch is thrown to permit a train to enter an approach in a direction receding from the island 11, the switch 168 is thrown temporarily to provide power from the capacitor 167 to the delayed pick-up timer 94, effectively canceling any effect of the latter, and to the RSO power circuit 169 that provides a substitute DC signal to maintain the relay 65 energized. The circuit 169 includes the oscillator 170 producing an AC signal upon being powered, and an amplifier 171 for amplifying the AC output from the oscillator 170, and a signal conversion circuit 172, which provides a positive voltage across the output terminals 63, 64 to maintain the movement detector relay 65 energized until the capacitor 167 has adequately discharged. The time constant for the capacitor 167 to discharge during which the circuit 166 overrides control of the relay 65 by the motion and/or low signal detectors is adequately short to avoid any danger of an unprotected crossing at the island 11 and is adequately long to avoid the inconvenience of an unnecessary down crossing gate at the crossing while a train is entering the main track receding from the island 11. By using an isolated capacitor 167 and a separate oscillator 170 in the RSO circuit 166, the output signal produced thereby will be distinctly on or off to assure distinct energizing or de-energizing of the relay 65 without any indistinct wavering of the relay 65 which might occur if the capacitor 167 were directly coupled to the relay and at the time such capacitor voltage has substantially dissipated.

THE TRANSMITTER

Figure 2:
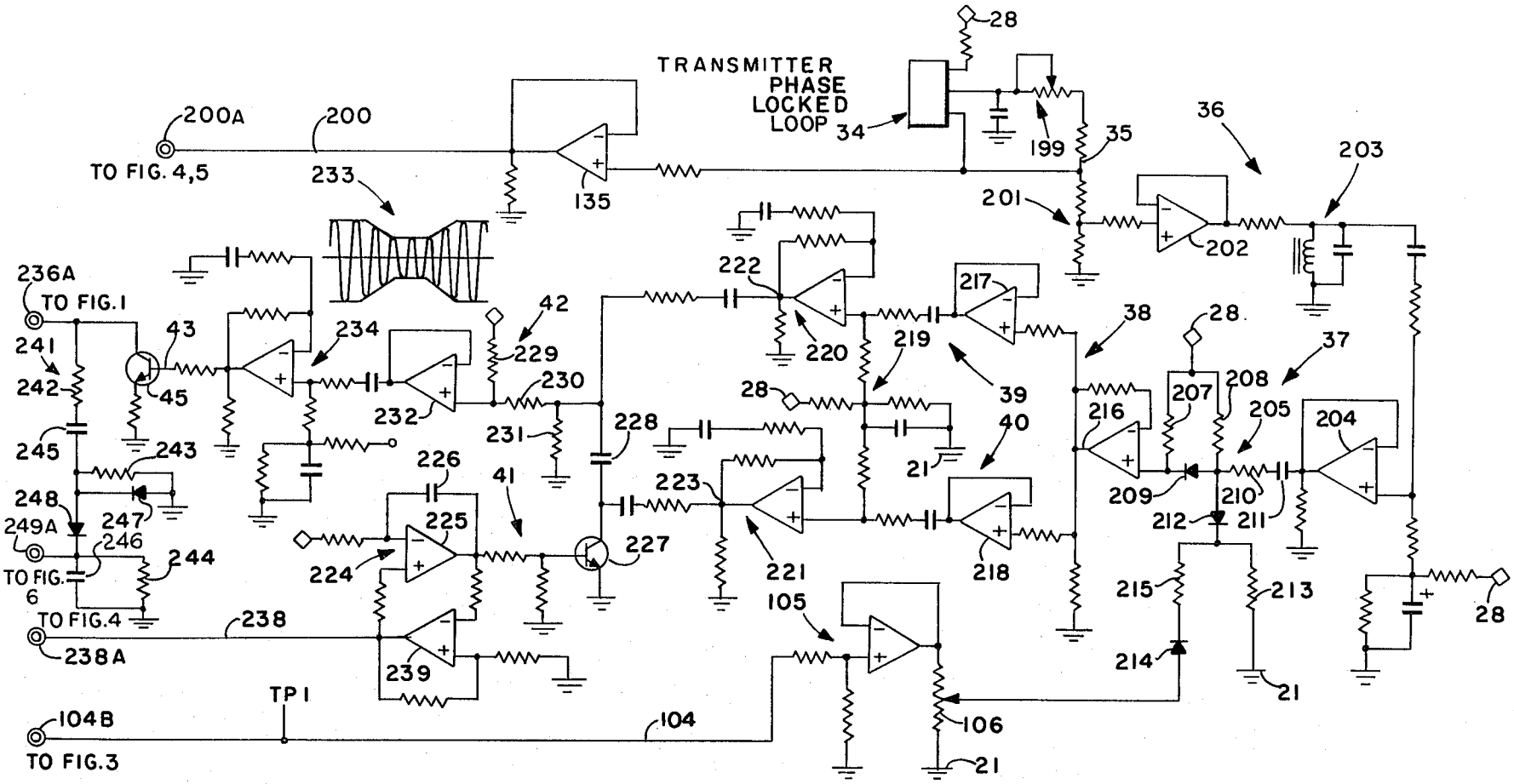
FIG. 2 is a schematic electric circuit diagram of the transmitter of the train approach detector.

Turning now to FIG. 2, the AC signal generator 34 is a phase locked loop circuit to which a frequency adjusting potentiometer and capacitor circuit 199 is connected. The AC input signal on line 35 is delivered as an AC checking pulse train via the isolating buffer amplifier 135, line 200 and terminal 200A to terminal 200B in the high signal detector 59 (FIG. 4) and terminal 200C in the low signal detector bypass circuit 60 (FIG. 5). The AC input signal on line 35 also is delivered via a voltage divider 201 and an isolating buffer amplifier 202 to a wave shaping circuit 203, which may include one or more capacitors and inductors that convert the square wave signal output from the amplifier 202 to a sine wave signal. A further buffer amplifier 204 provides isolation for the sine wave signal in the wave shaping circuit 203 and delivers an amplified sine wave output to the transmitter automatic gain control amplifier 37.

At the input to the gain control amplifier 37 is a diode and resistor signal attenuating circuit 205, which attenuates the sine wave signal output from the buffer amplifier 204 by an amount in proportion to the gain control signal received from line 104, buffer amplifier 105, and basic gain adjusting potentiometer 106. The attenuating circuit 205 includes a connection terminal 28 receiving $V_{cc}$ power, a pair of large resistors, say 4.7 megohms, 207, 208, diode 209, and input resistor 210 and capacitor 211, the latter effectively providing AC coupling from the amplifier 204 to the circuit 205. The attenuating circuit 205 also includes a further diode 212, a resistor 213 for connecting a signal to ground 21 and a diode 214 and resistor 215 for receiving the gain control signal ($V_{cor}$), which has a magnitude proportional to the gain control signal 104 and the level or gain control setting of the potentiometer 106. It will, of course, be appreciated that the larger the gain control signal ($V_{cor}$), the smaller will be the proportion of the sine wave signal received by the attenuating circuit 205 that will be shunted through the diode 212 and resistor 213 to ground 21; conversely, the smaller the gain control signal, the larger the effective attenuation of the sine wave signal, i.e. shunting thereof to ground 21. Thus, the frequency of the sine wave signal at the output 216 from the transmitter automatic gain control amplifier 37 will be the same as the AC input signal from the phase locked loop 34 and will have an amplitude that depends on the magnitude of the gain control signal ($V_{cor}$).

The two amplifier channels 39, 40 of the splitter circuit 38 preferably are identical so that each in effect receives half the attenuated or gain adjusted sine wave signal at output 216 from the amplifier 37. Each channel 39, 40 includes, for example, an isolating buffer amplifier 217, 218, a common power input circuit 219, and a pair of gain amplifier stages 220, 221 which deliver respective sine wave signals, still maintaining their common frequency relationship, to the amplifier outputs 222, 223. The modulating circuit 41, then, modulates the sine wave signal from output 223. The modulating circuit 41 includes a quadrature amplifier with two low frequency, say from 5 to 15 and preferably about 10, pulses per second. Such amplifier particularly includes a triangle or sawtooth wave generator 224, including an amplifier 225 and feed-back capacitor 226, which delivers a triangle shape modulation signal to a modulating transistor 227 that in turn modulates the sine wave signal from output 223 to confine the same effectively within an envelope defined by the shape of such triangle signal, which has a lower frequency than the sine wave signal. A capacitor 228 isolates the modulating circuit 41 from the output of the gain amplifier 220. Then, both the modulated sine wave signal from channel 40 and the unmodulated sine wave signal from channel 39 are combined or summed in a high input impedance summing junction 42, which includes several input resistors 229, 230, 231 and buffer amplifier 232.

The output signal from buffer amplifier 232 is a sine wave signal having the same frequency as the AC input signal from the phase locked loop 34, but such sine wave signal is partially modulated according to the triangular shape of the modulation signal from the modulating circuit 41, as is illustrated, for example, at 233. It will be appreciated that although the signal 233 passes through a relative zero level according to the frequency of the AC input signal, i.e. two times in each cycle, such signal will not be modulated to zero at the frequency of the modulation signal. The partially modulated AC sine wave signal at the output of the buffer amplifier 232 is further amplified by a gain amplifier 234, and the amplified output from the latter operates via the track driver transistor amplifier 45 to drive the transformer 46 to develop the track signal, which is filtered by the transmitter filter 47 and then delivered to the track rails via leads 4, 5 (FIG. 1). As was noted above, the filter 47 is operative effectively to pass every pulse of the sine wave received thereby. The filter only sees a slight change of amplitude between adjacent pulses passed. Therefore, a so-called solid frequency signal continuously is received and passed by the filter 47 so that third harmonic distortion encountered in prior systems is appreciably minimized.

Thus, terminal 236A provides connection between the track driver transistor 45 and the transformer 46. Terminal 104B is connected to terminal 104A (FIG. 3) to receive the gain control signal, and line 238 and terminal 238A connect the output of an amplifier 239 in the modulating circuit quadrature amplifier 41 that provides the modulation check signal, e.g. a square wave signal at the same frequency as the triangular modulation signal from triangle generator 234, for delivery via terminal 238B (FIG. 4) to the modulation checking circuit 155. Moreover, the collector output of the track driver transistor 45 is connected to an rms circuit 241, which includes resistors 242-244, capacitors 245, 246 and diodes 247, 248, that provides a signal at line 249 and terminal 249A that is the rms equivalent of the signal output from the track driver transistor 45. The terminal 249A is connected in turn to the terminal 249A' of the meter select switch 33 (FIG. 6) to enable the meter 32 to display the rms value of the track current.

According to the preferred embodiment and best mode of the invention, the phase locked loop 34 produces the AC input signal on line 35 having an equal mark space ratio. The buffer amplifiers 202, 204 are respective portions of a quad amplifier that provide good signal isolation. The wave shaping circuit 203 forms a passive filter. The four amplifier stages illustrated in the channels 39, 40 of the splitter 38 also preferably are individual amplifier circuit portions of a common integrated circuit further to assure equality of the sine wave signals at amplifier outputs 222, 223. The sine wave signal at output 222 has a constant level, and the sine wave signal at output 223 is fully modulated by the modulation signal. The transmitter filter 47, which in effect receives the partially modulated AC track signal, preferably is a high quality, slow recovery four pole filter which has a 35 db signal rejection adjacent channel separation.

THE RECEIVER MOVEMENT DETECTOR, LEVEL CONTROL, VOLTAGE CLAMP AND MODULATION CHECKING CIRCUITS

Figure 3:
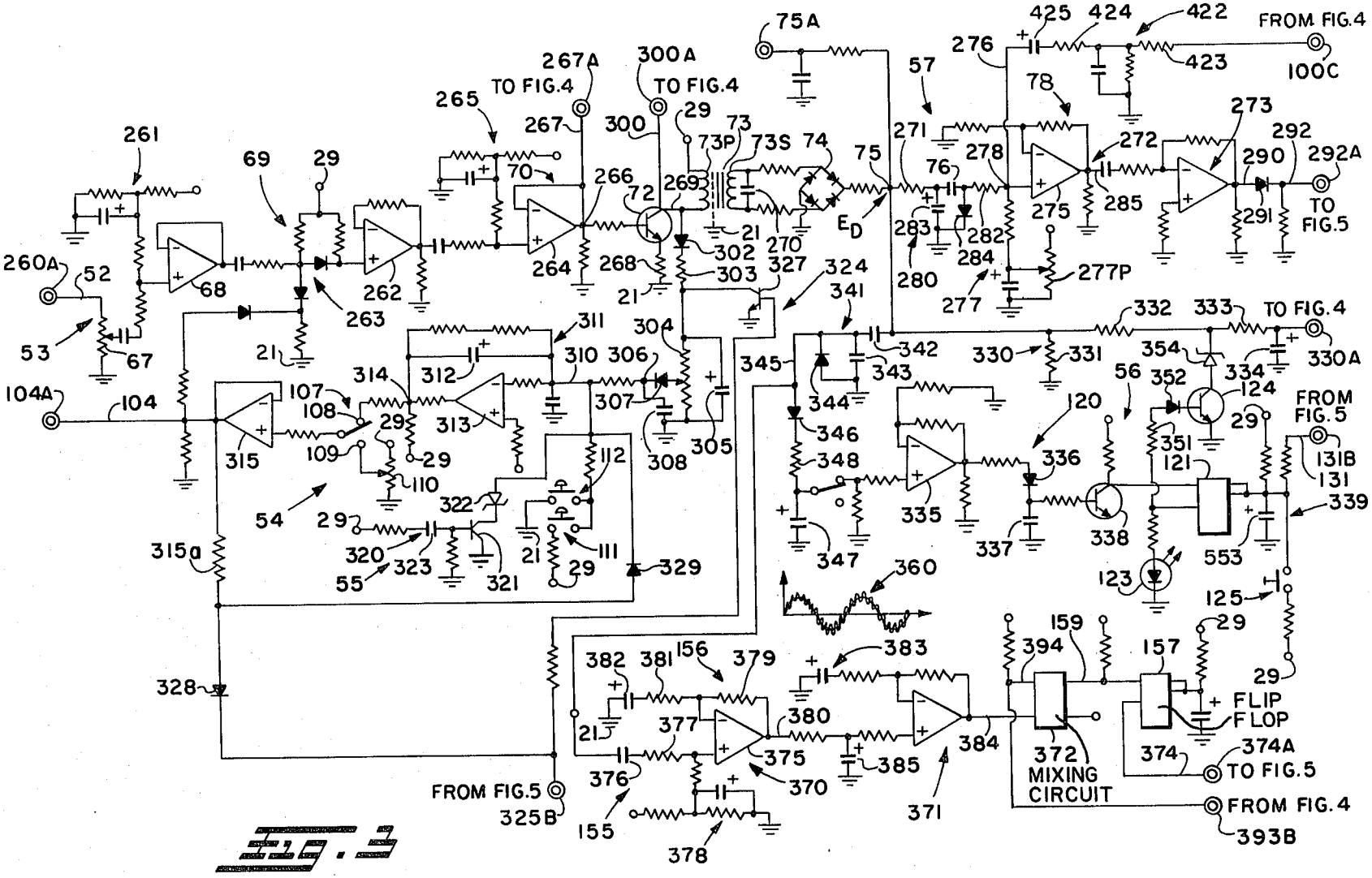
FIGS. 3–7 are schematic electric circuit diagrams of various portions of the receiver of the train approach detector.

Referring now to FIG. 3, the received track signal, i.e. the track signal received on leads 6, 7 and filtered by the receiver filter 50 is coupled via terminal 260A to the master gain adjusting potentiometer 67. Of course, the amplitude or magnitude of the received track signal will be a function of the magnitude of the input track signal developed in the transmitter 2 and coupled to the track 10 at leads 4, 5 as well as of the lumped impedance, including the track ballast, of the track 10 and any shunt, e.g. provided by a vehicle through the wheels and axle thereof, located on the track rails between a beginning of approach shunt 14, 15 and the island 11. Preferably the receiver filter 50 is a good one having slow recovery properties, say about six poles, and 55–60 db signal rejection adjacent channel separation characteristics when used particularly with the desired track signal of the partially modulated type, as is developed in the transmitter 2. It will be appreciated that reference to the track signal, the track signal magnitude, amplitude or level, and/or the track signal frequency throughout this application means the actual track signal or a signal proportionally related thereto or to the particular parameter or characteristic thereof, as will be quite apparent to those having ordinary skill in the art in view of the descriptive context and/or the circuit illustrations hereof.

In the input circuit 53 the track signal from potentiometer 67 is delivered to an input of the buffer amplifier 68, which has an offset bias circuit 261 associated therewith. The buffer amplifier 68 provides signal isolation, and the output therefrom is coupled to the receiver automatic gain control amplifier 69, which includes a gain amplifier 262 that receives at its non-inverting input the track signal as it may be attenuated by a diode and resistor signal attenuating circuit 263, which operates in the same manner as the attenuating circuit 205 described above with reference to FIG. 2. Therefore, the partially modulated AC track signal output from the buffer amplifier 68 will be attenuated in proportion to the magnitude of the gain control signal on line 104. The buffer amplifier 105 (FIG. 2) effectively isolates that portion of the gain control signal delivered to the attenuating circuit 263 and that delivered to the attenuating circuit 205. Preferably the impedances of the respective attenuating circuits 263, 205 are such that in response to changes in the magnitude of the gain control signal on line 104 the gain control effected in the transmitter 2 will be about three times as great as that effected in the receiver 3. A further buffer amplifier 264, which has an offset bias circuit 265 connected to the non-inverting input thereof provides output isolation for the receiver automatic gain control amplifier 69. A true AC signal that is partially modulated and is level controlled is produced, then, at the output 266 of the buffer amplifier 264. Thus, it will be appreciated that both the buffer amplifiers 68, 264 provide a high level of isolation for the gain control amplifier 69 for optimum accuracy of control by the latter. Similarly, in the transmitter 2 (FIG. 1) the buffer amplifiers 204, 217, 218 provide isolation for the transmitter automatic gain control amplifier 37.

The partially modulated AC sine wave track signal as the movement detector signal at the output 266 of amplifier 264 is coupled via line 267, terminal 267A and terminal 267B (FIG. 4) as an input to the low signal detector 58. Output 266 also is connected to the movement detector driver transistor 72. The emitter of transistor 72 is coupled via resistor 268 to ground 21 and the collector is connected via line 269 to one side of the primary 73P of transformer 73, the other side of which is connected via terminal 29 to receive a source of $V_{cc}$ power. Upon receiving the AC movement detector signal, the movement detector driver transistor 72 causes an AC signal to drive the transformer primary 73P which induces an AC signal in the secondary 73S, A filter capacitor 270 and the full wave rectifier 74 convert the AC signal from transformer secondary 73S to a substantially DC signal value, the $E_D$ signal, which has a ripple voltage impressed thereon. The magnitude of the $E_D$ voltage is directly proportional to the magnitude of the track signal received by the receiver 3.

The $E_D$ voltage at line 75 is received by a resistor 271 at the input to the motion detecting circuit 57 which includes a movement detector amplifier circuit 272, a high gain amplifier, such as a Schmitt trigger amplifier 273, and a wave shaping circuit 274 (FIG. 5). The movement detector amplifier circuit 272 includes an AC amplifier 275, which receives a comparison signal on line 276. A bias control voltage developing circuit 277 develops a bias control voltage which also is delivered with the comparison signal on line 276 to the non-inverting input 278 of the AC amplifier 275. The movement detector circuit 57 also includes at its input a capacitor, diode, and isolating resistor circuit 280, including the capacitor 76 connected between resistor 271 and a resistor 282, a capacitor 283 connected between the junction of resistor 271 and capacitor 76 on the one hand and ground 21 on the other hand, and a diode 284 connected between the junction of capacitor 76 and resistor 282 and ground 21. The sizes of the resistor 271 and of the components in the circuits 277, 280 are selected so that ordinarily the junction between capacitor 76, resistor 282, and diode 284 is maintained at approximately zero relative voltage and the junction of resistor 271 and capacitors 76, 283 is maintained approximately at the $E_D$ voltage; also, the comparison signal on line 276 is an AC signal which under ordinary circumstances when the $E_D$ voltage does not change or is changing in a relatively slow manner is amplified by the amplifier 275 to produce an AC signal output on line 285. The capacitor 283 filters the $E_D$ voltage to minimize any AC ripple therein. However, the $E_D$ voltage at line 75 will decline in magnitude as the leading wheels of an approaching train within one of the approaches 12, 13 move toward the island 11. As the $E_D$ voltage declines, the voltage at the junction of resistor 271 and capacitors 281, 283 will decline, but the capacitor 76 will strive to maintain a constant potential difference across itself; therefore, the voltage at the junction of capacitor 76, resistor 282 and diode 284 will be pulled down to a negative value. When the rate of decline or dropping of the $E_D$ voltage and, therefore, the rate at which the junction of capacitor 76, resistor 282 and diode 284 drops exceeds a predetermined magnitude so as to cancel the AC signal effect of the comparison signal on line 276 on amplifier 275, the output of the latter will become a DC steady state signal or an AC signal that is too small to drive the amplifier 273 to produce its normal pulse train output. Therefore, a DC signal will appear at the output 290 of amplifier 273 and will be coupled via diode 291, line 292 and terminal 292A to terminal 292B at the input of the wave shaping circuit 275 (FIG. 5). Thus, it will be appreciated that an AC pulse train produced at terminal 292A indicates that the motion of an approaching train has not been detected by the motion detecting circuit 57; whereas a DC signal or a zero signal at terminal 292A indicates that movement has been detected.

As is known, the magnitude of the $E_D$ voltage will vary nonlinearly with the distance of a shunt across the track rails from the detector tie point to the track. The closer an approaching train is to the tie points the greater will be the change in $E_D$ voltage of a given movement of the train. Therefore, the detector 1 is speed and distance sensitive in that it will be operative to drop the crossing gate at the island at a time during which an approaching train is in an approach that depends on the train speed. The faster the train approaches, the sooner it will be detected by the motion detecting circuit. The potentiometer 277P in the adjusting circuit 277 adjusts the magnitude of the rate of $E_D$ voltage drop necessary for detection of an approaching train by the detector 1.

Line 300 and terminals 300A and 300B (FIG. 4) connect the collector of the movement detector driver transistor 72 to the input of the island detector 61. Ordinarily, when a track signal is received by the receiver 3, the movement detector driver transistor 72 will cause a pulse train to appear at its collector and line 300 as it causes an AC signal to be produced in the transformer primary 73P. However, when a train is in the island and shunts the rails therein, no track signal or an extremely small one is received by the receiver 3 so that the movement detector driver transistor 72 will produce either a DC signal or an AC signal of an extremely low amplitude on line 300, with such signal indicating the presence of a train in the island. The island detector 61 responds to such island signal on line 300 to decode the same, as will be described further below.

A diode 302, resistor 303, potentiometer 304, and capacitor 305 provide an input to the level control circuit 54 from the collector of the movement detector driver transistor 72. Interaction of the circuit elements 302-305 causes the ordinary voltage at node 306 to be a DC voltage level, which is approximately directly proportional to the $E_D$ voltage, with an AC ripple signal impressed thereon. The potentiometer 304 may be adjusted to set the magnitude at which the level control circuit 54 strives to maintain the $E_D$ voltage, which occurs at junction 75. A diode 307 further rectifies the signal from potentiometer 304 and a capacitor 308 further filters the level control input signal from such diode. Such lever control input signal, then, is received at the input 310 to a level control integrator circuit 311. The integrator 311 includes a large integrating capacitor 312, an integrating amplifier 313, and associated resistors and capacitors to provide at its output 314 a slowly varying signal. The mode control switch 107 selectively connects the output from the integrator 311 via automatic mode terminal 108 to an isolating buffer amplifier 315 from which the gain control signal is delivered on line 104.

Since the level control input signal is provided to the inverting input of the integrator 311, the magnitude of the gain control signal on line 104 will vary approximately in inverse relation to the magnitude of the $E_D$ voltage and will accordingly strive to control the gains of the transmitter and receiver automatic gain control amplifiers 37, 69 in an effort to maintain substantially constant the magnitude of the $E_D$ voltage. Moreover, since the integrator 311 is a relatively slow one, taking, for example, about ten to twenty minutes to correct the $E_D$ voltage in response to a change in the received track signal, the level control circuit 54 will effectively maintain the $E_D$ voltage substantially constant as relatively slow variations in the track ballast occur but will have little effect on the $E_D$ voltage as it is caused to change relatively rapidly in response to a moving train within the approach area monitored by the detector 1.

By throwing the switch 107 to the manual mode in engagement with the manual terminal 109, a manually set constant level control signal is delivered to the buffer amplifier 315 to provide a constant magnitude gain control signal on line 104 developed according to setting of potentiometer 110. When the level control circuit 54 is operating in a manual mode, there will, of course, be no automatic gain control or correction of the $E_D$ voltage to its nominal level of, for example, 40 volts DC. Rather, the transmitter 2 will be operational in a substantially constant current mode to deliver a track signal of constant current, whereby the track signal voltage and particularly the $E_D$ voltage will vary with changes in ballast. Operation in the manual mode may be employed when it is for some reason undesirable to correct the $E_D$ voltage for track ballast variations.

The switches 111, 112 may be selectively operated by a service person to apply extreme input signals to the level control circuit 54. For example, closure of the down switch 111 applies a maximum voltage to the inverting input of the integrator 311 to effect a relatively rapid downward change in the magnitude of the gain control signal on line 104, which also causes the $E_D$ voltage to drop. Similarly, selective closure of the up switch 112 provides a ground or minimum signal to the inverting input of the integrator 311 so that the gain control signal will rapidly change upward increasing the magnitude of the $E_D$ voltage.

The initialize circuit 55 includes a resistor and capacitor charging circuit 320, a control transistor 321, and a diode 322. When the detector 1 initially receives power, the voltage applied to $V_{cc}$ terminal 29 biases transistor 321 to conduction, which pulls low, i.e. approximately to ground potential, the inverting input of the integrator 311, thereby causing the level control circuit 54 to tend to produce a maximum gain control signal on line 104, which effects a relatively rapid rise in the $E_D$ voltage toward its nominal level. However, when the capacitor 323 adequately charges, say in from about five to about fifteen seconds after power has been received at $V_{cc}$ terminal 29, the transistor 321 is cut off, and the level control circuit 54 then operates in its normal automatic mode of operation, assuming the switch 107 to be in its automatic mode position.

To avoid overdriving the detector 1 and to prevent the level control circuit 54 from correcting the gain control $V_{corr}$ and thus the $E_D$ signal out of a low signal condition when the track signal drops below the low signal level, a gain holding circuit 324 is operative in response to a gain holding signal received at terminal 325B from line 325 and terminal 325A of the low signal detector output circuit 326 (FIG. 5) to hold substantially constant the $V_{corr}$ signal at just below the level it had been when the track signal dropped below the low signal level. The gain holding signal is a positive voltage which saturates a holding transistor 327. Therefore, any signal received through diode 302 and resistor 303 is coupled to ground 21 via the holding transistor 327 so as not to affect the level control circuit 54 while at the same time the diode 307 at the input to the level control circuit 54 isolates the input 310 from the ground connection provided by the transistor 327. Also, the gain holding signal at terminal 325B is applied to a diode 328 to reverse bias the same so that the output from amplifier 315 is fed back through resistor 315A to provide a level control input signal via isolating diode 329 to the input 310 causing a gain control signal at a constant magnitude just below its immediately preceding level to be produced on line 104, thereby holding constant the gains of the transmitter and receiver automatic gain control amplifiers 37, 69 while a low signal condition exists. Such slightly lower $V_{corr}$ signal prevents the gain control circuit 54 from correcting the $E_D$ voltage above the low signal level. When the track signal voltage exceeds the low signal level, the gain holding signal at terminal 325B will be terminated to, for example, a ground signal, thereby cutting off the holding transistor 327 and terminating the prior level control signal provided through the resistor 315*a*, which is then coupled to ground via diode 328 and terminal 325B, and the diode 329, which then isolates the input 310 from the resistor 315*a* and diode 328.

It is undesirable for the $E_D$ voltage to change too rapidly. Therefore, an $E_D$ rate control circuit 330, which includes resistors 331, 332, 333 and capacitor 334, is coupled to the junction 75 and is operative in conventional manner to limit the maximum rate of change of the $E_D$ voltage. A terminal 75A couples the $E_D$ signal to terminal 75B (FIG. 6) of the meter select switch 33 to enable the meter 32 to display the $E_D$ voltage. Moreover, a terminal 330A couples a signal proportional to the $E_D$ voltage from the $E_D$ rate control circuit 330 to the terminal 330B (FIG. 4) at the input of the high signal detector 59.

Also, it is undesirable for the $E_D$ voltage substantially to exceed its nominal level when a train, which is stopped in an approach before the track signal had dropped below the low signal level, begins receding from the island, for at that time the gain of the detector 1 may be relatively high, as the level control circuit 54 tries to correct the $E_D$ voltage upward even to an extent that may cause the $E_D$ signal to exceed the high signal level. Therefore, the voltage clamp circuit 56 is operative for a predetermined duration upon sensing the initial receding movement of a train from the island to limit the maximum rise of the $E_D$ voltage. Such time delay typically may be on the order of about ten minutes, for usually there will not be a train encountered in the island 11 within ten minutes of the receding one. The voltage clamping circuit 56 includes a high gain receding movement amplifier 335; a diode 336; a capacitor 337, which forms a time delay circuit; a transistor driving amplifier 338; a clamp timer 121, such as a 555IC with an associated RC timing circuit 339; and a clamp circuit 124, such as a saturable transistor. A capacitor and diode filter 341, which includes AC coupling, DC blocking capacitor 342, filter capacitor 343, and diode 344, provides on line 345 a pulse train representative of the filtered ripple pulse component, i.e. an AC signal, of the $E_D$ voltage. Such AC signal is rectified by diode 346 and the rectified signal is filtered by a filter and storage capacitor 347. The diode 346 isolates the voltage clamping circuit 56 from rapid downward changes of the $E_D$ voltage during which the capacitor 347 might otherwise discharge through the resistor 348.

In response to the occurrence of a receding train causing a rise in the $E_D$ signal, the amplifier 335 will produce an AC output signal which is rectified by diode 336 and causes the transistor amplifier 338 to deliver a start timing signal on line 349 to trigger the clamp timer 121. The clamp timer then produces a positive claim signal on line 350 which operates through a resistor 351 and diode 352 to saturate the transistor clamp circuit 124. The saturated transistor 124 then effects operative coupling of a zener diode voltage clamp 354 between the junction of resistors 332, 333 and ground 21 to limit the maximum voltage to which the $E_D$ signal at junction 75 may rise. The clamping signal on line 350 also effects energization of the light emitting diode 123 to emit light indicating that the voltage clamping circuit 56 is operating to clamp the $E_D$ voltage.

A cancel switch 125 may be selectively closed by a service person to provide substantially instantaneous charging of the time delay circuit 339 thereby cancelling the clamping effect of the voltage clamping circuit 56. Moreover, a clamp cancelling signal may be provided to terminal 131B from line 131 and 131A (FIG. 5) of the low signal detector output circuit 326 to cancel the clamping action of the voltage clamping circuit 56 when the track signal is below the low signal level and to allow starting of the, say, eight to ten minute time period of the clamping circuit 56 when a receding train passes the low signal track location or when a stopped train in an approach outside such low signal track location begins to recede.

The mode adjusting switch 107 has ganged for movement therewith a switch 107A which is coupled to the input of the voltage clamping circuit 56. As shown, the switch 107A enables the voltage clamping circuit 56. However, when the switch 107 is thrown to the manual mode to engage terminal 109 terminating automatic $E_D$ level control, the switch 107A normally also is thrown to disable the voltage clamping circuit.

The capacitor 337 delays the rise of the control signal to the base of transistor amplifier 338. Therefore, if there is a sudden break in a track rail causing a near instantaneous, relatively large rise in the $E_D$ voltage, for a short period of time, the transistor amplifier 338 will not deliver a start timing signal on line 349 and the voltage clamping circuit 56 will not clamp the $E_D$ voltage. Rather, the high signal detector 59 will sense the high $E_D$ voltage and drop the crossing gate and/or may energize the high signal clamp light emitting diode 150 to provide information to a service person that a high signal condition had previously occured even though such condition may have abated.

The modulation checking circuit 155 includes a calculated limited response amplifier 370, a gain amplifier 371, a signal mixing circuit 372, and a signal squaring and isolating output circuit 157. It is the purpose of the modulation checking circuit 155 to confirm that proper modulation is occurring in the transmitter 2 and that the received track signal has the proper modulation characteristic. The isolating output circuit 157 provides an AC modulation check pulse train via line 374 and terminal 374A when satisfactory modulation in the transmitter and receiver is sensed to terminal 374B (FIG. 5) to develop a signal for use in the output control circuit 62.

The calculated limited response amplifier 370 includes an integrated circuit operational amplifier 375 which receives the AC signal from filter 341 via a capacitor 376 and resistor 377 input circuit. Such received AC signal, which properly should have the same frequency and be in phase with the modulation signal produced by the modulating circuit 41 (FIG. 2) and should have a higher frequency ripple signal impressed thereon, is illustrated at 360 and is provided to the non-inverting input of the amplifier 375. Also coupled to such non-inverting input is a conventional offset bias circuit 378. A large resistor 379, say on the order of one megohm, provides a feed-back path from the output 380 of the amplifier 375 to the inverting input thereof. A resistor 381 and capacitor 382 also couple such inverting input to ground 21. The gain of amplifier 370 is a function of the ratio of the resistors 379, 381. The capacitor 382 is a storage and filter capacitor and it, in combination with the resistor 381, determines the approximate frequency at which the calculated limited response amplifier 370 will operate to produce a relatively noise-free AC output signal at the same frequency as the input signal delivered to the non-inverting input of the amplifier 375. In particular, the capacitor 382 should be sufficiently large to eliminate the high frequency ripple signal component impressed on the lower frequency signal portion of signal 360. When the frequency of the AC signal delivered to the non-inverting input of amplifier 375 is not the correct one, the magnitude of the output signal produced at output 380 will be relatively ineffective to operate the signal mixing circuit 372 even after being amplified by the gain amplifier 371. However, a signal delivered to the non-inverting input of amplifier 375 at a proper frequency will be amplified by the calculated limited response amplifier 370 and will be further amplified by the gain amplifier and low pass filter stage 371, which has a smoothing resistor and capacitor circuit 383 connected to its inverting input and a filtering capacitor 385 connected to its non-inverting input, to provide on line 384 a strong square wave signal that has the same frequency as and is approximately in phase with the modulation signal which is represented by the major ripple component of the $E_D$ voltage. Line 384 is connected to one input of the signal mixing circuit 372, which may be a conventional flip-flop circuit.

The flip-flop 372 usually triggers on a trailing negative going pulse portion. Since the calculated limited response amplifier 370 and the filter amplifier 371 eliminate the high frequency component, i.e. at the frequency of the input AC signal, the flip-flop 372 will trigger at the same frequency as the modulation signal.

The modulation check signal from the modulation check generator amplifier 239 (FIG. 2) is received at the input 390 of a flip-flop circuit 391 (FIG. 4), such as a 555 integrated circuit (IC). Upon receiving the pulse input from the terminal 238B, the circuit 391 produces a pulse train at its output 392, which is coupled by line 393 and terminals 393A and 393B (FIG. 3) to provide a pulse train to the input 394 of the signal mixing circuit 372. The pulse train on line 392 normally should be at least partly out of phase with the square wave pulse train on input 384. Therefore, in response to receiving proper at least partly out of phase pulse trains at its respective inputs, the signal mixing circuit 372 produces an AC signal on its output line 159; a DC signal would be produced on the output line 159 when one of the two AC inputs to the signal mixing circuit is not received or both such signals are improperly in phase. Upon receiving the proper AC signal from line 159, the isolating output circuit 157 produces the modulation checking pulse train on its output line 374 for delivery via terminals 374A and 374B (FIG. 5) to the output control circuit 62 as an indication of proper modulation in the detector 1 thereby operatively enabling the output control gate 85.

LOW SIGNAL, HIGH SIGNAL, AND ISLAND DETECTORS

Figure 4:
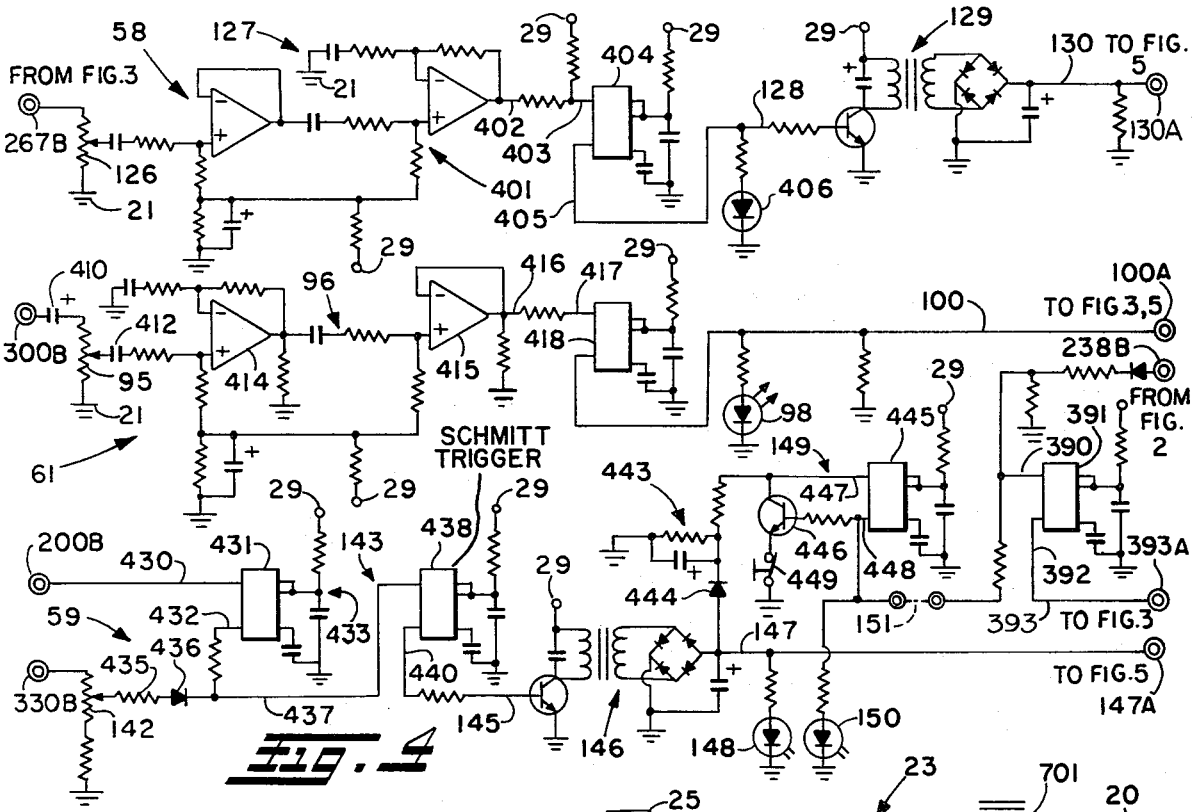
Figure 5:
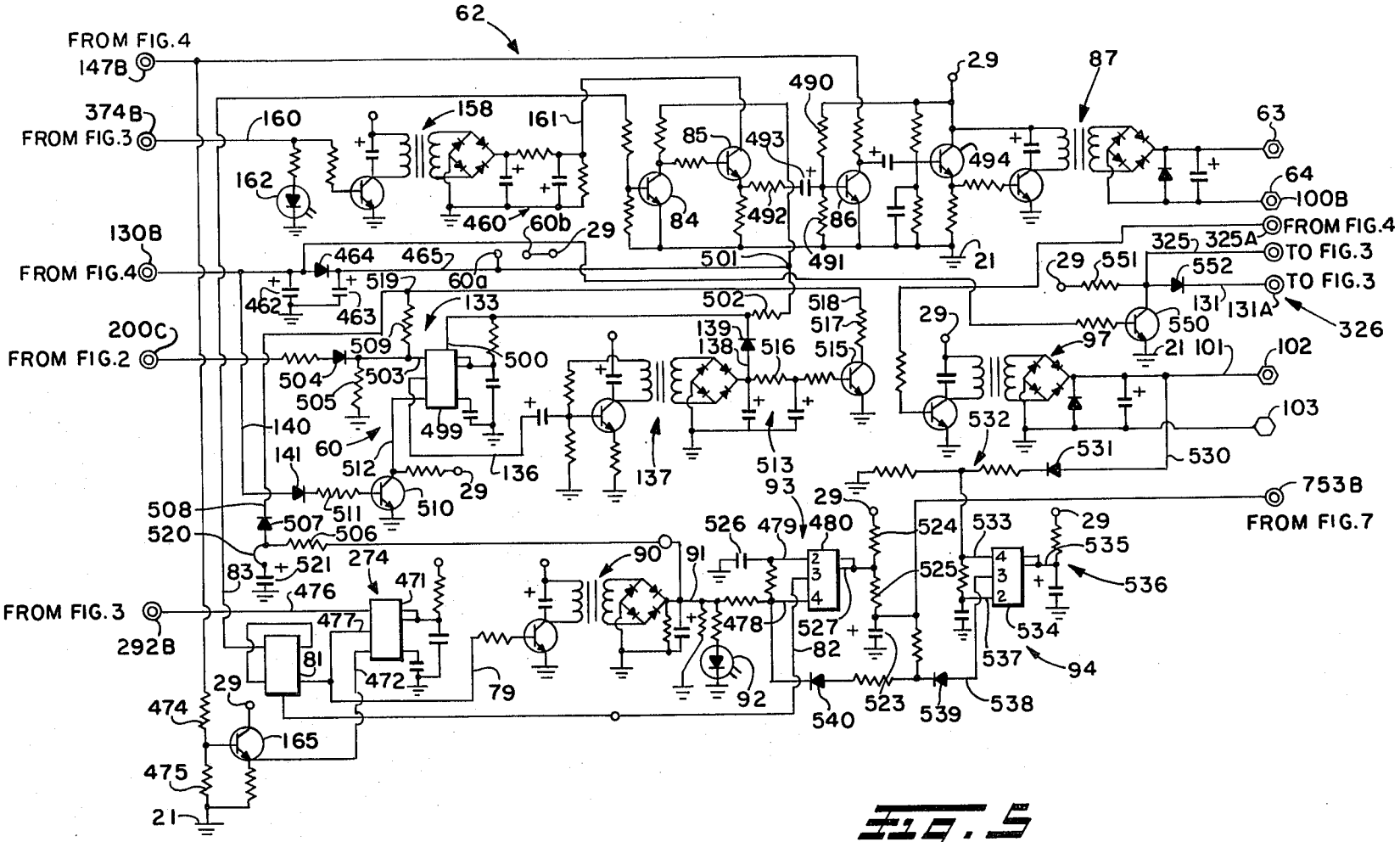

Turning now to FIG. 4, the low signal detector 58 receives a low signal condition monitoring input signal from the output 266 of amplifier 264 via terminals 267A (FIG. 3) and 267B. The low signal detector includes input potentiometer 126, which can be adjusted to set the low signal level of the received track signal below which the crossing gate at island 11 should be dropped. Typically such low signal level would be such that an approaching train from 20 to 40 percent into an approach would cause a low signal level condition to be sensed, thereby assuring dropping of the crossing gate. The potentiometer 126 provides such input signal to an AC signal amplifying circuit 401 which delivers an AC threshold signal at its output 402 to an input 403 of a free running threshold detector 404, such as a 555 IC with the illustrated RC connections. A DC bias voltage is also applied to the input 403 of the threshold detector 404. When the magnitude of the low signal condition monitoring input signal received by the low signal detector 58 exceeds the low signal level magnitude set on potentiometer 126, the magnitude of the AC threshold signal produced by the amplifying circuit 401 will be sufficiently great to cause the threshold detector 404 to produce an AC square wave pulse train on its output line 405 having a mark space characteristic the same as the AC threshold signal and, thus, as the low signal condition monitoring input signal and the modulation signal. The square wave pulse train on line 405 causes a light emitting diode 406 to flash indicating that the track signal is above the low signal level and also operates through the signal conversion circuit 129 to provide a positive DC voltage on line 130, which is coupled by terminals 130A and 130B (FIG. 5) to the output control circuit 62, which operatively enables output control gate 83, and to the low signal detector output circuit 326. On the other hand, when the low signal level is reached, i.e. the magnitude of the input signal to the potentiometer 126 is below the low signal level, the threshold detector 404 will produce a DC or zero signal on line 405 so that a DC or zero signal will be produced on line 130 to indicate that such a low signal condition is existing and thereby to disable output control gate 84.

In several places in the detector 1 isolation and/or threshold detector circuits are used for signal isolation, boosting and/or confirmation, say of receipt of certain signals, for example having a particular magnitude or having an AC component. Typically such threshold detectors have a square wave input, and the output thereof may be shaped to a sine wave signal or may be left a square wave, depending on the need for accuracy of signal conversion. The sine or square wave signal then is transformer coupled to a rectifier and possibly a filter to convert such signal to a DC output signal. The DC output signal then can be utilized. As a result of such threshold detecting, wave shaping and signal converting, the chance of a failure being caused by a DC signal jumping through a circuit component is minimized. The threshold detector 404 and signal conversion circuit 129 are an example of such a circuit utilization.

In the island detector 61 the island signal from the collector of the movement detector driver transistor 72 (FIG. 3) is received at terminal 300B. A capacitor 410 AC couples the AC signal portion of the island signal to the potentiometer 95 at the input to the island detector circuit 61, and a further AC coupling capacitor 412 couples the potentiometer to an amplifying circuit 96, which includes a gain amplifier 414 and an isolating buffer amplifier 415. The amplifying circuit 96 provides an AC signal at its output 416 when the AC signal portion of the island signal is above a minimum magnitude, which is adjustable according to the setting of the potentiometer 95, as an indication that no train is present in the island 11. However, when a train is present in the island, either no track signal is received by the receiver 3 or the magnitude of the received track signal and particularly the AC signal portion of the island produced on line 300 (FIG. 3) is so small that a substantially DC or zero signal will be produced at the output 416 of the amplifying circuit 413.

The output 416 is coupled to the input 417 of a threshold detector circuit 418, such as a 555 IC. When an AC signal of adequate magnitude is received at the input 417 of the threshold detector 418, the latter produces on its output 100 an AC pulse train as the island indicating signal, which causes periodic flashing of the light emitting diode 98 to indicate visually that a train is not occupying the island and that the island detector 61 is properly operating. The island indicating signal on line 100 is delivered via terminals 100A, 100B (FIG. 5) to the signal conversion circuit 97 which converts such signal to a positive DC signal on line 101 that energizes the island relay 66. When a train is occupying the island 11, the low or DC signal applied to the input 417 of the threshold detector 418 will cause the latter to produce a DC signal or a zero signal on its output line 100 and the island relay 66 will be de-energized to assure that the crossing gate will be down.

The island indicating signal pulse train also is coupled by terminal 420A to terminal 100C (FIG. 3) in the motion detecting circuit 57 to provide the comparison signal via line 276 to junction 278. An RC filter 422, resistors 423, 424, and capacitor 425 provide filtering, isolation, and voltage dropping of the island pulse train received at terminal 100C so that the comparison signal on line 276 will be a relatively small AC pulse train usually having an amplitude of three to four millivolts. It will be appreciated that by using the island pulse train to develop the comparison signal for the motion detecting circuit 57, a continuous check is made to confirm both that the island detector 61 is operating properly and that a proper track signal is being received by the receiver 3; if one or both is not true there will be no AC signal produced at output 285 of amplifier 275 and the crossing gate will be dropped.

At input terminal 200B of the high signal detector 59 (FIG. 4) the checking pulse train is received and applied to input 430 of an isolating trigger circuit 431. The circuit 431 may be 555 IC that produces at its output 432 a constant output pulse train of low current and fixed voltage upon receiving the checking pulse train at its input 430. A power input and timing circuit 433 is coupled, on the one hand, to the power and timing inputs of the circuit 431 and, on the other hand, to the $V_{cc}$ terminal 29. The high signal condition monitoring input voltage, which is directly proportional to the $E_D$ voltage, received at terminal 330B is delivered to the high signal setting potentiometer 142 by which the high signal level can be adjusted. Such high signal input voltage, or that portion thereof picked off from the potentiometer 142, is passed via a resistor 435 and isolating diode 436 to combine on line 437 with the constant output pulse train from the output 432 of the circuit 431. A trigger circuit 438, such as a Schmitt trigger circuit, is formed using a 555 IC. When the Schmitt trigger 438 receives an AC input signal of satisfactory magnitude, it will produce on line 440 a square wave signal which is converted by the signal conversion circuit 146 to a DC voltage on line 147 indicating that a high signal condition is not occuring and that the AC input signal generator 34 is properly producing the AC input signal and the checking pulse train on line 35. However, when the checking pulse train is not received via line 201, the circuit 431 will not produce the constant output pulse train so that the high signal condition monitoring signal on line 146 will become a zero voltage. Moreover, in the event that the track signal, the $E_D$ voltage, and particularly the high signal input voltage at terminal 330B exceeds the high signal level, a large magnitude or high DC voltage will appear on line 437 on which the constant output pulse train from line 432 will be impressed; however, due to the raised average level of the total signal on line 437, the pulses thereof will not effect triggering of the trigger circuit 438 so that a DC output will be produced on line 440. Therefore, a zero voltage will appear on line 147 indicating that a high signal condition exists.

The high signal condition indicating signal on line 147 is applied to a light emitting diode 148, which will be illuminated when there is a positive signal on line 147 to indicate that a high signal level is not existing and that the AC input signal generator 34 is operating properly. Moreover, the signal on line 147 is coupled via terminals 147A and 147B (FIG. 5) for use in the output control circuit 62 operatively to enable the output control gate 86 when there is no high signal condition occurring and the generating 34 is operating properly.

Also connected to line 147 is the high signal clamp circuit 149, which includes a filter and voltage divider input circuit 443 isolated from line 147 by a diode 444, a high-low signal detector 445, such as a 555 IC, and a latching transistor 446. When a positive signal appears on line 147, input 447 to circuit 445 also will be high so that the output 448 will be low or zero voltage, thus biasing the transistor 446 to a non-conductive condition and maintaining the light emitting diode 150 de-energized so as not to emit light. However, when there is a high signal condition or when the AC input signal generator 34 fails, the low voltage on line 147 causes the circuit 445 to produce a high signal at its output 448. Such high signal at output 448 biases the latching transistor 446 to conduction, which then maintains input 447 low regardless of subsequent changes in the voltage of line 147. The high signal at output 448 also energizes light emitting diode 150 to emit light indicating that a high signal does or had existed.

The reason for a high signal condition may be the occurrence of a broken rail in a monitored approach, as well as an extreme increase in the track ballast condition which cannot be compensated for by the level control circuit 54. However, although a broken rail may present a high impedance and thus cause a high signal to occur, it may later have a low impedance at the junction of two pieces of a broken rail, for example as the rail expands and contracts with temperature. Therefore, although the high signal condition caused by a broken rail may abate at times, the high signal latch circuit 149 and diode 150 illuminated thereby will inform a service person that such a high signal condition had existed; and the service person then ordinarily would check the rails in the monitored approach to find the broken rail or to confirm that there is no broken rail. A switch 440 may be selectively operated by the service person to reset the latch circuit 149 after a high signal condition has ended by opening the emitter circuit of the transistor 446, whereupon the circuit 445 will reset to produce a low signal at its output 448.

If desired, the jumper connection may be provided at 151. Such jumper connection in particular provides the high signal produced at the output 448 of the high signal clamp circuit 149, when, say, a high signal condition has occurred, to the input 390 of the flip-flop or isolating trigger circuit 391, which ordinarily receives the modulation check signal from terminal 238B and modulation checking amplifier 239 (FIG. 2). By coupling the high signal to input 390 of circuit 391, the latter is prevented from producing an AC pulse train on its output line 392. Therefore, the pulse train normally provided via terminals 393A, 393B to the input 394 of the signal mixing circuit 372 (FIG. 3) will be terminated, thus terminating the AC modulation check pulse from circuit 157 to cause the output control circuit 62 to operate to drop the crossing gate. On the other hand, with the jumper 151 removed, the high signal condition indicating signal at line 147 will cause the crossing gate to drop or pick up, depending upon whether a high signal condition does or does not exist; but latching of the crossing gate in the down position after a high signal condition has abated will not occur.

THE OUTPUT CONTROL CIRCUIT

Turning now to FIG. 5, the high signal condition indicating signal on line 147 is received at terminal 147B from the high signal detector 59. When there is no high signal condition existing and when the checking pulse train is properly produced by the AC input signal generator 34, the positive signal on line 147 provides $V_{cc}$ power to the collector of the transistor gate 86 enabling the same to operate, as will be described further below. Moreover, when a proper AC pulse train modulation check signal is received at terminal 347B from the modulation checking circuit 155, which indicates that the modulating circuit 41 is operating properly to modulate partially the AC track signal and that the received track signal is causing a proper $E_D$ signal at junction 75 (FIG. 3), the signal conversion circuit 158, which includes an output filter 460, delivers on line 161 a DC signal that is provided as $V_{cc}$ power to the collector of the second transistor gate 85 enabling the latter to operate as will be described further below. The AC modulation check signal at terminal 374B also causes the light emitting diode 162 to flash to indicate that proper modulation is occurring and a proper $E_D$ signal is being produced at junction 75. The low signal condition indicating signal is received at terminal 130B from the low signal detector 58 (FIG. 4). A positive DC voltage from the low signal detector is applied via filter capacitor 462 and storage capacitor 463 and isolating diode 464 to line 465 to provide a $V_{cc}$ power signal to the first gate transistor 84 enabling the latter to operate as will be described further below.

The wave shaping circuit 274 of the motion detecting circuit 57 includes a threshold detector 471, which may be a 555 IC. The threshold detector 471 is enabled by a high signal provided to its input 472 via an amplifier 165 upon being biased to conduction by a positive high signal condition indicating signal received via line 147 and the voltage divider formed by resistors 474, 475 when no high signal condition exists. However, if there were a high signal condition existing, the high signal condition indicating signal on line 147 becomes a zero voltage disabling the threshold detector 471. When the motion of an approaching train has not been detected by the motion detecting circuit 57, the Schmitt trigger 273 (FIG. 3) will provide a pulse train via terminal 292B (FIG. 5) to the triggering input 476 of the threshold detector 471; assuming the latter to be enabled by a high signal on line 472, an AC pulse train will be produced at the output 477 thereof. The pulse train on line 477 is converted by a signal conversion circuit 90 to a positive DC signal on line 91 which initially provides relatively high and relatively low input signals to the inputs 478, 479 of the delayed pick up timer circuit 93, which may include a 555 IC mixer circuit 480. The circuit 480 then produces a low signal on its output 82 that enables flip-flop 81. The positive signal on line 91 also energizes a light emitting diode 92 to indicate enablement of the flip-flop 81. Upon receiving the pulse train on line 447 the enabled flip-flop 81, then, produces the AC square wave signal on line 83 that drives the output control gates 84–86 in the output control circuit 62. Such AC square wave signal has a frequency that is one half the frequency of the pulse train appearing on line 477 at the output of the threshold detector 471, which latter signal has the same frequency as the modulation signal from the modulating circuit 41.

It will be appreciated, therefore, that throughout the detector 1, with the exception of the square wave pulse train on line 83, all of the AC signals preferably should have the same frequency as that of the modulation signal produced by the modulating circuit 41 or of the AC input signal produced by the AC input signal generator 34. This provision facilitates signal checking, signal comparing, circuit operation checking, overall circuit design, and signal confirmation, i.e. confirmation that a proper track signal from the correct transmitter 2 is being received by the receiver 3.

The AC square wave signal on line 83 is intended to be passed by the output control circuit gates 84, 85, 86 to energize the relay 65 when the motion of a train has not been detected and all other track and detector conditions are within tolerable parametric boundaries. Accordingly, such AC square wave signal is provided to the base of the transistor gate 84, whih is enabled, for example, by a positive $V_{cc}$ signal on line 465 from the low signal detector 58. The enabled transistor gate 84 then provides an AC signal at its collector output to drive the base of the second transistor gate 85, which also will produce an AC signal at its emitter output when enabled with a $V_{cc}$ signal at its collector in response to receipt at terminal 374B of the pulse train of the modulation checking signal.

When a positive DC high signal condition indicating signal is received on line 147 from the high signal detector 59 to provide $V_{cc}$ power to the collector of transistor gate 86, the $V_{cc}$ power provided from terminal 29 via voltage divider resistors 490, 491 will cause the transistor gate 86 to be saturated providing a substantially unimpeded path to ground 21. However, the AC square wave signal output from the emitter of the enabled driven transistor gate 85 operates through the resistor 492 and capacitor 493 cyclically to drive the transistor gate 86 out of saturation, thereby causing the latter to produce at its collector output a square wave signal output. Further, the square wave signal output from the third transistor gate 86 is amplified by an input transistor amplifier stage 494 to provide a solid square wave input signal to the signal conversion circuit 87, which produces the output information, i.e. a positive DC signal across terminals 63, 64 to energize the relay 65 picking up the crossing gate at the island 11.

It will be appreciated that any of the following, a zero high signal condition indicating signal at terminal 147B, lack of an AC modulation checking signal at terminal 374B, a zero DC low signal condition indicating signal at terminal 130B, or a DC motion signal at terminal 292B will cause a termination of delivery of the square wave signal to the input transistor amplifier stage 494, thereby causing a zero output signal to be produced across the output terminals 63, 64 de-energizing the relay 65 and dropping the crossing gate at the island 11.

In accordance with the present invention it is desired to disable the effect of the low signal detector on the output control circuit 62, in particular on the first transistor gate 84, when the motion of an approaching train has been detected. The reason for this disablement is to minimize ring by, i.e. to expedite pick-up of the crossing gate, after a receding train, the motion of which had been detected before a low signal condition had occurred, leaves the island. The low signal detector bypass circuit 60 provides such function.

The low signal detector bypass circuit 60 includes the low signal detector bypass amplifier 133, which may be a 555 IC 499. It is the purpose of the bypass circuit 60 to provide a $V_{cc}$ signal to transistor gate 84.

A source of $V_{cc}$ power is provided terminal 500 of the IC 499 from the positive low signal condition indicating signal at terminal 130B, when no low signal condition is occurring, via line 465, junction 501 and resistor 502. An AC signal input, namely the checking pulse train, from terminal 200C normally is provided terminal 503 of IC 499 via a diode 504 and ground reference resistor 505.

When the motion of an approaching train has not been sensed by the motion detecting circuit 57, a high signal on line 91 is provided via resistor 506, diode 507, line 508, and resistor 509 to the input 503 of the IC 499 to override any effect on the latter by the checking pulse train. However, when approaching motion has been sensed, the low or zero signal at line 91 eliminates the mentioned overriding of the checking pulse train; rather, the IC 499 may now be considered primed ready to produce an AC signal at its output line 136 in response to such checking pulse train, subject to the saturated or non-conductive state of a low signal control transistor 510.

The low signal control transistor 510 is connected via a resistor 511 and diode 141 to monitor the low signal condition indicating signal received at terminal 130B from the low signal detector 58. When a low signal condition is not occurring, the positive DC voltage at terminal 130B drives the low signal control transistor 510 to saturation causing a zero level or shunting to ground of the input 512 of IC 499 effectively preventing the same from delivering an AC signal at its output 136 even though an appropriate AC signal input, namely the non-overriden checking pulse train from terminal 200C, is properly received at its input 503. On the other hand, when the low signal condition indicating signal received at terminal 130B becomes zero, i.e. upon the occurrence of a low signal condition, the low signal control transistor 510 will block the signal provided its collector input thereby to cause a high signal to be provided from the $V_{cc}$ terminal 29 to the input 512 of the IC 499, whereupon the latter produces an AC signal on its output line 136.

The signal conversion circuit 137 then converts the received AC signal from line 136 to a positive DC voltage on line 138. Such voltage is filtered by the RC filter 513 to minimize any ripple therein. The DC signal on line 138, then, is provided via the isolating diode 139 and resistor 502 to the junction 501 with line 465 to provide a $V_{cc}$ signal to the first transistor gate 84. The positive DC signal on line 138 also continues a $V_{cc}$ power supply to terminal 500 of the amplifier 133.

Normally the positive DC low signal condition indicating signal received at terminal 130B and appearing on line 465 as the $V_{cc}$ input to the transistor gate 84 also maintains the storage capacitor 463 charged. The capacitor 463 temporarily assures a supply of $V_{cc}$ power to terminal 500 while the low signal detector bypass circuit begins operation to produce a DC signal on line 138. A transistor 515 is coupled by resistor 516 to the output of the filter 511 and the collector output of such transistor is coupled by resistor 517 and line 518 to a junction 519 with resistor 509 and line 508. The components 515–518 are a clamp circuit that clamps the voltage at the junction 519 to a low level when a positive DC signal at line 138 causes saturation of the transistor 515. Therefore, after the low signal detector bypass circuit 60 becomes operational, a recovery of motion, i.e. the production of a positive high signal at line 91 cannot disable the bypass circuit 60 operation. Rather, the bypass circuit 60 will continue to provide $V_{cc}$ power to the gate 84 until the receding train has passed the low signal track location, whereupon the low signal control transistor 510 again saturates to disable the bypass circuit 60.

A jumper 520 may be selectively connected or removed to connect or remove a capacitor 521 from circuit connection with the junction 522 with the resistor 506 and diode 507. The jumper 520 determines whether, in response to the occurrence of a sudden shunt on the track at a position between the island 11 and the low signal location, the detector 1 will operate in a low signal mode or in a low signal bypass mode. For example, without the jumper 520 and capacitor 521 in connection with junction 522, a sudden shunt across the track rails that immediately causes low signal detection and motion detection results in a zero signal at line 91 and a non-conductive low signal control transistor 510; therefore the low signal detector bypass circuit 60 operates. Such low signal detection effect will occur after motion detection due to the charges stored in capacitors 462, 463. On the other hand, with the jumper 520 and capacitor 521 connected as shown, in response to a sudden shunt such capacitor slows down the effective rate at which the signal on line 91 disappears; therefore, a low signal condition will manifest itself by disabling the low signal detector bypass circuit 60 and cutting off the $V_{cc}$ power to gate 84. The jumper 520 thus provides optional operational control of detector 1 in a manner that is particularly useful when train detector equipment is used to monitor single ended approaches, i.e. to look along the track only in a single direction from the tie points to the track.

It is the purpose of the delayed pick-up timer 93 to operate after the motion of an approaching train has been detected and the crossing gate has been dropped to prevent a brief pick-up of the crossing gate if motion detection is briefly lost, for example due to the approaching train running over a rusty rail. Since the delayed pick-up timer circuit 93 provides a ten second delay each time motion detection is lost, rather than from the beginning of motion detection, continuous protection is maintained at the island even during intermittent shunting which might occur and continue intermittently during an approaching move.

The delayed pick-up timer includes connected to the mixer 480 a charging capacitor 523 and resistors 524, 525 for charging such capacitor from the $V_{cc}$ terminal 29. When motion has been detected, the low signal appearing at line 91 causes the voltage at input 478 to be lower than the voltage at input 479, which is held up by storage capacitor 526. Therefore, the circuit 480 will produce a high signal on its output line 82 which will disable the flip-flop 81 from producing the AC signal square wave signal on its output line 83. The capacitor 523 will then discharge relatively rapidly primarily through resistors 525 and input 527 of the circuit 480. However, if detection of motion is lost, whereupon an AC signal is received at terminal 292B, a high signal appearing at line 91 will not cause the circuit 480 to produce a low enabling signal for the flip-flop 81 until after the relatively fixed time it takes for the capacitor 523 to charge to an adequate voltage. Such charging time takes about ten seconds which usually is adequate for the previously detected approaching train to clear the rusty rail and to have its approaching motion redetected.

When the island indicating signal pulse train is received at terminal 100B from the island detector 61 (FIG. 4), the signal conversion circuit 97 produces a positive voltage at its output line 101 which energizes the island relay 66. However, when a train occupies the island 11, the island indicating signal pulse train is terminated whereupon a zero signal appears on line 101 dropping the island relay 66, which assures that the crossing gate at the island 11 will remain down regardless of the energized or de-energized condition of the relay 65. The signal from line 101 also is coupled via line 530, diode 531, and resistance voltage divider 532 to an input 533 of the cancel circuit 94, which may include a 555 IC 534. Connected to one input 535 of the circuit 534 is an RC charging time delay circuit 536 which has a longer time constant than that of the delayed pick-up timer circuit.

It is the purpose of the DPU cancel circuit 94 to operate promptly upon a train leaving the island 11 at which time the island indicating signal pulse train is re-established. The input 533 of circuit 534 then goes high relative to the input 537, which causes the circuit 534 to produce a high signal on its output 538 until the RC circuit 536 has adequately charged. Such high signal on line 538 is applied via diode 539 promptly to charge capacitor 520 and via a diode 540 to the input 478 of the circuit 480. The circuit 480 then promptly produces a low signal on its output 82 to enable the flip-flop 470. When a train leaves the island, then, the DPU cancel circuit 94 will continue to produce the high signal on line 538 to maintain the flip-flop 81 enabled and the DPU timer 93 cancelled for several seconds longer than the time capability of the latter.

Moreover, assuming that the low signal detector 58 is bypassed by the low signal detector bypass circuit, i.e. the approaching motion of the train just leaving the island had been previously detected, and since the $E_D$ signal will be rising due to the receding train, an AC signal will be received at terminal 292B relatively promptly after the receding train has left the island so that the AC square wave signal promptly will be produced on line 83 to energize the relay 65 to pick up the crossing gate. However, if the receding train had been sensed by the low signal detector before the motion of such train had been detected, the crossing gate will not be picked up until the receding train passes the low signal track location. Although such delay in picking up the crossing gate is a nuisance, it also provides an indication to a service person that for some reason trains are not being sensed by the motion detecting circuit 57 and that an apropriate adjustment should be made.

The low signal detector output circuit 326 includes a transistor 550 which normally is biased to saturation by the positive DC low signal condition indicating signal received at terminal 130B from the low signal detector 58 (FIG. 4) when a low signal condition is not occurring. The saturated transistor 550 couples the $V_{cc}$ signal from terminal 29 through resistor 551 to ground 21, thereby causing a relatively low or zero signal to appear at terminals 325A and 131A, which are separated by isolating diode 552 and are connected, respectively, to terminal 325B (FIG. 3) for cutting off the holding transistor 327 and forward biasing diode 328 and to terminal 131B (FIG. 3) at the voltage clamping circuit 56. However, when a low signal condition occurs, the zero signal at terminal 150B cuts off the transistor 550, whereupon high signals are delivered from terminals 325A and 131A, on the one hand to energize the holding transistor 327 and to reverse bias the diode 328 in the level control circuit and, on the other hand, to provide a clamp cancel signal which promptly charges the timing capacitor 553 of the time delay circuit 121 to terminate the clamping operation of the voltage clamping circuit 56.

THE METERING CIRCUITRY

Figure 6:
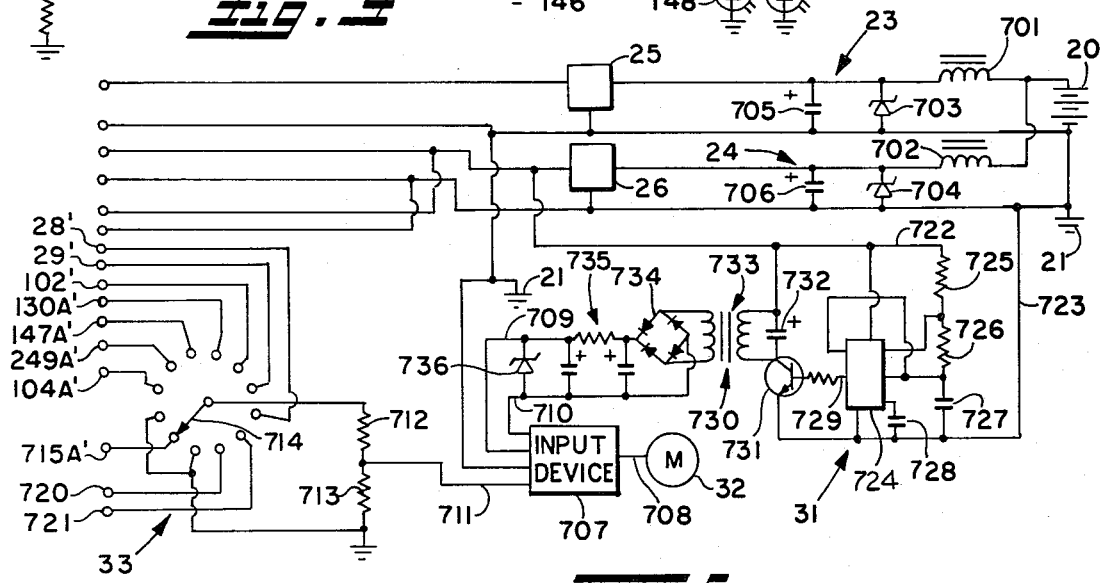

Referring to FIG. 6, each of the surge filters 23, 24 is a conventional one including, for example, an inductor 701, 702, a zener diode 703, 704, and a capacitor 705, 706. Moreover, each of the regulators 25, 26 may be, for example, an integrated circuit Model No. LM340K8.

The meter 32 is powered by a DC to DC converter 31 and receives driving inputs via a conventional integrated circuit input device 707, such as integrated circuit Model No. ICL7106, which is connected to the meter by a bus line 708. The circuit 707 is connected to ground 21, to power terminals 709, 710 and to terminal 711, which is coupled in a resistance divider circuit of resistors 712, 713 to receive signal inputs from the meter select switch 33. The various terminals to which the movable contact 714 may be selectively connected in the meter select switch 33 are identified by primed reference numerals corresponding to the unprimed numbered terminals in FIGS. 1–5 to check, respectively, the $V_{cc}$ voltages from regulators 25, 26 at terminals 28', 29'; to check the outputs from the island detector 61 at terminal 102', low signal detector 58 at terminal 130A', and high signal detector 59 at terminal 147A'; to indicate the track current of the track signal produced in the transmitter 2 at terminal 249A', the gain control signal ($V_{corr}$) from the level control circuit 54 at terminal 104A', and the $E_D$ voltage junction 75 in the receiver 3 at terminal 715A (FIG. 3) and 715A'; and to provide an off position 720 and a check position 721 to which a reference voltage may be applied to check the meter calibration, for example.

The DC to DC converter 31 receives input power from the regulator 26 across lines 722, 723. The converter 31 includes an integrated circuit oscillator 724, such as a 555 IC, to which resistors 725, 726 and capacitors 727, 728 are connected in conventional manner to produce an AC signal at output 729. The AC signal from output 729 drives a signal conversion circuit 730, which includes a transistor 731, capacitor filter 732, coupling transformer 733, full wave rectifier 734, and RC filter 735. A zener diode 736 is coupled across the filter 735 at its output side. In operation, the converter 31, upon receiving power input across lines 722, 723, provides an AC signal from the oscillator 724. The signal conversion circuit 730 converts such AC signal to a DC signal which is filtered by the filter 735 and regulated by the zener diode 736 to provide regulated power to the circuit 707 for driving the meter 32. Thus, upon receiving power from the DC to DC converter 31 and various input signals from the meter select switch 33, the circuit 707 and meter 32 are operable to display the values of such signals as they occur in the detector 1 without requiring extensive test probes and metering equipment external of the detector 1.

REVERSE SWITCH OVERRIDE

Figure 7:
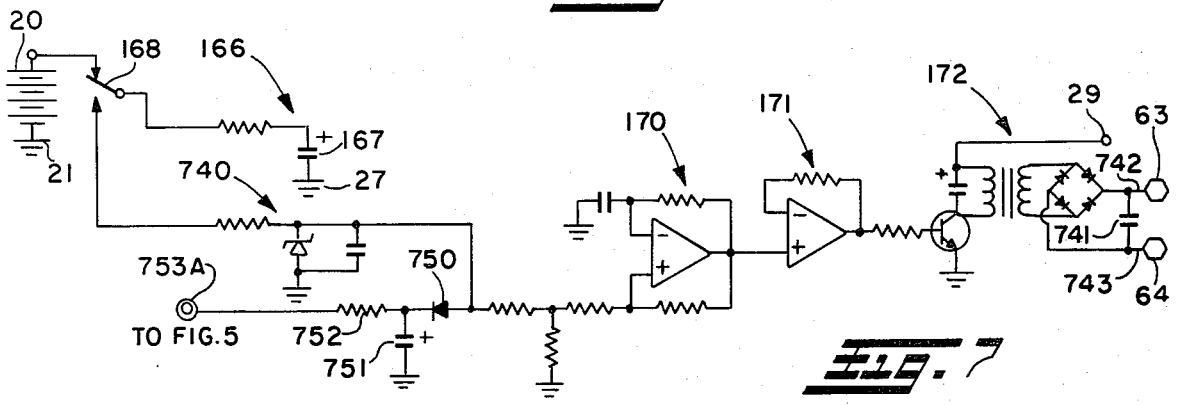

In the reverse switch override control circuit 166 shown in FIG. 7, switch 168 normally provides power directly from the battery 20 to charge capacitor 167. However, when a track switch is thrown to permit a train to enter an approach in a direction receding from the island 11, the switch 168 also is automatically thrown to discharge the capacitor 167 via a regulating filter 740 to power the oscillator 170. An AC output from the oscillator 170 is amplified by amplifier 171 and the amplified output from the latter drives a signal conversion circuit 172, across which a filter capacitor 741 is connected, to provide on lines 742, 743 a positive DC voltage that is connected to the output terminals 63, 64 of the relay 65 to maintain the same energized and the crossing gate picked up for the, say, eight to fifteen second discharge period of the capacitor 167. When the track switch is so thrown, the motion detecting circuit 57 may sense such a change in the track signal that would indicate detection of an approaching train; therefore, in order to avoid dropping the crossing gate while the motion detecting circuit 57 recovers, for example, the surrogate signal is provided to the relay 65 by the reverse switch override control circuit 166.

Moreover, since the motion detecting circuit 57 may detect approaching motion upon such throwing of the track switch, the delayed pick up timer 93 would be started. In order to avoid dropping of the crossing gate in the event that the reverse switch override control circuit 166 were to stop producing the surrogate signal before the delayed pick-up timer 93 had timed out, the signal from the discharging capacitor 167 promptly cancels the timing action of the delayed pick-up timer. In particular, the capacitor 167 also discharges through isolating diode 750, capacitor 751, and large resistor 752, which is connected by line 753 and terminals 753A, 753B (FIG. 5) to provide a cancel signal that rapidly charges the capacitor 520 in the delayed pick-up timer circuit 93. Charging of capacitor 520 will take, for example, one-half second, which ordinarily would be much longer than the discharge time of the capacitor 167. Therefore, the motion detecting circuit 57 normally will recover fully from any motion sensing caused by the mentioned track switching well before the surrogate signal provided by the reverse switch override control circuit 166 is terminated so that the crossing gate at the island 11 will not be dropped while such track switch is thrown to its off-normal position.

STATEMENT OF INDUSTRIAL APPLICATION

In view of the foregoing, it will be clear that the train approach detector 1 of the present invention may be used to detect trains on a track, in particular such trains in a monitored approach and approaching an island. The detector 1 is capable of monitoring track conditions and has self-checking ability.

I claim:

1. A circuit for developing an AC output signal, comprising input means for providing an input AC signal, plural channel means for dividing such input AC signal into plural respective AC signals, modulating means for modulating one of such respective AC signals, combining means for summing such modulated AC signal and at least another one of such respective AC signals to obtain a combined AC signal, filter output means for filtering such combined AC signal to produce such AC output signal, and coupling means for coupling such AC output signal to a track and detector means also coupled to such track for responding to changes in such AC output signal as an indication of at least one of the passing of a vehicle on the track and the condition of the track.

2. The combination of claim 1 further comprising automatic gain control means for automatically adjusting the level of such input AC signal in response to the magnitude of such AC output signal received by said detector means, whereby said automatic gain control means strives to maintain the magnitude of such AC output signal received by said detector means substantially constant.

3. Apparatus for detecting a vehicle on a track, comprising transmitter means for transmitting an AC track signal in the track, and receiver means for receiving such track signal, including detector means for monitoring a parameter of such track signal representative of such a vehicle, and output means responsive to such detector means for producing output information indicative of such vehicle on such track, said transmitter means including input means for providing an AC input signal, plural channel means for dividing such input AC signal into plural respective AC signals having a common frequency, modulating means for modulating one of such respective AC signals at a lower frequency than such common frequency, combining means for summing such modulated AC signal and at least another one of such respective AC signal to obtain a combined AC signal which is not modulated to zero at such lower frequency, and filter output means for filtering such combined AC signal to produce such track signal.

4. The apparatus of claim 3, further comprising combined level control means responsive to the magnitude of the received track signal by said receiver means for adjusting the gain of said receiver means and for correspondingly adjusting the gain of said transmitter means to try to maintain such magnitude substantially constant.

5. The apparatus of claim 3, further comprising level control means responsive to the magnitude of the received track signal for adjusting the gain of said receiver means to try to maintain such magnitude substantially constant.

6. The apparatus of claim 4, said level control means including means for adjusting the gain of said transmitter means by a directly proportional amount larger than the directly proportional amount of adjustment of the gain of said receiver means.

7. The apparatus of claim 4, further comprising means for stopping further adjustment of gain when the magnitude of the received track signals drops below a predetermined value.

8. Apparatus for detecting a vehicle on a track, comprising transmitter means for transmitting an AC track signal in the track, and receiver means for receiving such track signal, including detector means for monitoring a parameter of such track signal representative of such a vehicle, and output means responsive to such detector means for producing output information indicative of such vehicle on such track, said transmitter means including input means for providing an AC input signal, plural channel means for dividing such input AC signal into plural respective AC signals having a common frequency, modulating means for modulating one respective AC signal at a lower frequency than such common frequency, combining means for combining such modulated respective AC signal and at least one such other respective AC signal to obtain a combined AC signal which is not modulated to zero at such lower frequency, and filter output means for filtering such combined AC signal to produce such track signal, said filter output means comprising slow recovery filter means for passing such combined AC signal at such common frequency, whereby since such combined AC signal is not modulated to zero at such lower frequency third harmonic distortion is minimized.

9. Apparatus for detecting a vehicle on a track, comprising transmitter means for transmitting an AC track signal in the track, and receiver means for receiving such track signal, including detector means for monitoring a parameter of such track signal representative of such a vehicle, and output means responsive to such detector means for producing output information indicative of such vehicle on such track, said transmitter means including input means for providing an AC input signal, plural channel means for dividing such input AC signal into plural respective AC signals having a common frequency, modulating means for modulating one respective AC signal at a lower frequency than such common frequency, combining means for combining such modulated respective AC signal and at least one such other respective AC signal to obtain a combined AC signal which is not modulated to zero at such lower frequency, filter output means for filtering such combined AC signal to produce such track signal, combining level control means responsive to the magnitude of the received track signal by said receiver means for adjusting the gain of said receiver means and for correspondingly adjusting the gain of said transmitter means to try to maintain such magnitude substantially constant, coupling means for coupling said transmitter means and said receiver means at tie points to the track, and clamp means for limiting the rise of such received track signal in said detector means in response to a vehicle on the track leaving such tie points.

10. Apparatus for detecting a vehicle on a track, comprising transmitter means for transmitting an AC track signal in the track, and receiver means for receiving such track signal, including detector means for monitoring a parameter of such track signal representative of such a vehicle, and output means responsive to such detector means for producing output information indicative of such vehicle on such track, said transmitter means including input means for providing an AC input signal, plural channel means for dividing such input AC signal into plural respective AC signals having a common frequency, modulating means for modulating one respective AC signal at a lower frequency than such common frequency, combining means for combining such modulated respective AC signal and at least one such other respective AC signal to obtain a combined AC signal which is not modulated to zero at such lower frequency, and filter output means for filtering such combined AC signal to produce such track signal, further comprising combined level control means responsive to the magnitude of the received track signal by said receiver means for adjusting the gain of said receiver means and for correspondingly adjusting the gain of said transmitter means to try to maintain such magnitude substantially constant, means for stopping further adjustment of gain when the magnitude of the received track signals drops below a predetermined value, and further comprising low signal detector means for sensing when the magnitude of such track signal received at said receiver means drops below such predetermined value, including control means responsive to such low signal detector means for effecting production of output information when the magnitude of such track signal drops below such predetermined value.

11. The apparatus of claim 10, further comprising by-pass means for by-passing such low signal detector means to prevent production of such output information thereby when such vehicle is detected before the magnitude of such track signal drops below such predetermined value, said by-pass means also including means for holding constant the adjusted gain by said level control means.

12. Apparatus for detecting a vehicle on a track, comprising transmitter means for transmitting an AC track signal in the track, including means for producing an AC signal and modulating means for modulating at least part of such AC signal to produce such track signal, receiver means for receiving such track signal, including detector means for monitoring a parameter of such track signal representative of such vehicle, output means responsive to such detection of such a vehicle by said detector means for producing output information indicative of such vehicle on such track, and modulating signal producing means directly electrically coupled to both said transmitter means and said output means independently of such track for producing a modulating signal output to control said modulating means to modulate such AC signal and to enable said output means to respond to such detection and to disable said output means upon termination of such modulating signal output.

13. Apparatus for detecting a vehicle on a track, comprising transmitter means for transmitting an AC track signal in the track, including means for producing an AC signal and modulating means for modulating at least part of such AC signal to produce such track signal, receiver means for receiving such track signal, including detector means for monitoring a parameter of such track signal representative of such vehicle, output means responsive to such detection of such a vehicle by said detector means for producing output information indicative of such vehicle on such track, and modulating signal producing means coupled to both said transmitter means and said output means for producing a modulating signal output to control said modulating means to modulate such AC signal and to enable said output means to respond to such detection and to disable said output means upon termination of such modulating signal output, said modulating signal producing means comprising means for producing such modulating signal output as two pulse trains, and connecting means for connecting one pulse train to said modulating means and the other to said output means.

14. The apparatus of claim 13, further comprising sensing means for sensing whether such track signal is received by said receiver means, said output means comprising combining means for combining information from said sensing means and such other pulse train to enable said output means when both such track signal is received and such other pulse train is produced and when either or both are not received or produced to disable said output means.

15. Apparatus for detecting a vehicle on a track, comprising transmitter means for transmitting an AC track signal in the track, including means for producing an AC signal and modulating means for modulating at least part of such AC signal to produce such track signal, receiver means for receiving such track signal, including detector means for monitoring a parameter of such track signal representative of such vehicle, output means responsive to such detection of such a vehicle by said detector means for producing output information indicative of such vehicle on such track, modulating signal producing means coupled to both said transmitter means and said output means for producing a modulating signal output to control said modulating means to modulate such AC signal and to enable said output means to respond to such detection and to disable said output means upon termination of such modulating signal output, said modulating signal producing means comprising means for producing such modulating signal output as two pulse trains, connecting means for connecting one pulse train to said modulating means and the other to said output means, sensing means for sensing whether such track signal is received by said receiver means, said output means comprising combining means for combining information from said sensing means and such other pulse train to enable said output means when both such track signal is received and such other pulse train is produced and when either or both are not received or produced to disable said output means, said receiver means comprising converting means for converting such received track signal to a substantially DC signal value with ripple pulses impressed thereon, and said sensing means comprising means for sensing such ripple pulses.

16. Apparatus for detecting a vehicle on a track, comprising transmitter means for transmitting an AC track signal in the track, including means for producing an AC signal and modulating means for modulating at least part of such AC signal to produce such track signal, receiver means for receiving such track signal, including detector means for monitoring a parameter of such track signal representative of such vehicle, output means responsive to such detection of such a vehicle by said detector means for producing output information indicative of such vehicle on such track, and modulating signal producing means coupled to both said transmitter means and said output means for producing a modulating signal output to control said modulating means to modulate such AC signal and to enable said output means to respond to such detection and to disable said output means upon termination of such modulating signal output, said modulating signal producing means comprising means for producing such modulating signal output as two pulse trains, and connecting means for connecting one pulse train to said modulating means and the other to said output means and further comprising sensing means for sensing whether such track signal is received by said receiver means, said output means comprising combining means for combining information from said sensing means and such other pulse train to enable said output means when both such track signal is received and such other pulse train is produced and when either or both are not received or produced to disable said output means, said receiver means comprising converting means for converting such received track signal to a substantially DC signal value with ripple pulses impressed thereon, and said sensing means comprising means for sensing such ripple pulses, and amplifier means for amplifying such ripple pulses and trigger means for producing a square wave pulse train in response to receipt of such amplified pulses.

17. The apparatus of claim 16, said combining means comprising flip-flop means for producing an enabling signal for said output means when both said other pulse train and said square wave pulse train are received by said flip-flop means.

18. In an apparatus for detecting a vehicle on a track, including transmitter means for transmitting a track signal and receiver means for receiving such track signal for monitoring a parameter thereof, said receiver means including output means for producing an output indicative of the excursion of such monitored parameter beyond at least one of predetermined limits, the improvement comprising:

checking means for checking the correct operation of at least one portion of at least one of said transmitter means and receiver means while combining such checking function with such monitoring of such parameter function, said checking means including pulse train means for delivering as an output therefrom a pulse train when such one portion is properly operating and such parameter is within such limits, and overriding means for overriding effective delivery of such pulse train when at least one of such portion is not properly operating and such parameter is beyond such limits.

19. The improvement of claim 18, said pulse train means comprising an integrated circuit for producing a pulse train at its output in response to receipt of a predetermined input signal.

20. The improvement of claim 19, said overriding means comprising circuit means coupled to the output of said pulse train means for overriding such pulse train.

21. The improvement of claim 20, said checking means further comprising trigger means responsive to receipt of such pulse train and to excursions thereof beyond respective trigger levels for producing an output AC signal, and said circuit means comprising means for biasing said trigger means to a level such that excursions of such pulse train will not pass both such trigger levels, thereby terminating such output AC signal.

22. The improvement of claim 18, said transmitter means including means for developing such track signal as an AC track signal in response to an input AC signal, and said checking means comprising coupling means for coupling such AC input signal to said pulse train means.

23. The improvement of claim 22, said receiver means including high signal detector means for detecting excursions of such track signal beyond a predetermined magnitude, and said checking means further comprising high signal coupling means for coupling a biasing signal representative of such extreme excursion to said overriding means for overriding effective delivery of such pulse train.

24. The improvement of claim 23, said checking means further comprising trigger means responsive to receipt of such pulse train and to excursions thereof beyond respective trigger levels for producing an output AC signal, and said high signal coupling means comprising circuit means for biasing said trigger means to a level such that excursions of such pulse train will not pass both such trigger levels, thereby terminating such output AC signal.

25. The improvement of claim 24, further comprising means for coupling said transmitter means and said receiver means at tie points to such track, movement detector means for detecting movement of a vehicle on such track approaching said tie points, and connecting means for connecting said movement detector means to said output means to operate the latter to indicate such approaching vehicle upon detecting the same.

26. Apparatus for detecting an approaching object, comprising transmitter means for transmitting a transmitted signal capable of attenuation by such an approaching object, receiver means for receiving such transmitted signal, including detector means for monitoring such attenuation of such transmitted signal for detecting such approaching object, level control means for automatically adjusting the gain of at least one of said transmitter means and receiver means, and clamp means for temporarily limiting maximum rise of such transmitted signal in said receiver means when such object begins receding.

27. The apparatus of claim 26, such object comprising a vehicle on a track, further comprising coupling means for coupling said transmitter means and said receiver means at tie points to such track, and said clamp means comprising means for temporarily limiting maximum rise of such transmitted signal in said receiver means when such vehicle begins receding from such tie points.

28. The apparatus of claim 26, further comprising high signal detector means for producing a distinguishable output when such transmitted signal in said receiver means exceeds a predetermined magnitude, and said clamp means being operative to clamp such transmitted signal in said receiver means to a magnitude below such predetermined magnitude.

29. The apparatus of claim 28, further comprising time delay means for slowing the speed of operation of said clamp means so that a near instant rise in such transmitted signal above such predetermined magnitude causes said high signal detector means to produce such distinguishable output.

30. The apparatus of claim 26, said transmitter means comprising means for transmitting such transmitted signal as an AC signal, said receiver means including converting means for converting such received AC signal to a DC signal having a magnitude proportionally representative of that of such AC signal, and said clamp means comprising a DC voltage limiting means for limiting the maximum amplitude of such DC signal and switch means for connecting said limiting means in operable relation in said receiver means to so limit the magnitude of such DC signal.

31. The apparatus of claim 26, further comprising disabling means for disabling said clamp means so as not temporarily to limit such maximum rise when the magnitude of such transmitted signal drops below a predetermined magnitude.

32. The apparatus of claim 31, said disabling means comprising a low signal detector means for detecting excursions of such transmitted signal received by said receiver means below a predetermined magnitude.

33. The apparatus of claim 32, such object comprising a vehicle on a track, further comprising coupling means for coupling said transmitter means and said receiver means at tie points to such track, motion detector means responsive to such transmitted signal for detecting motion of a vehicle approaching such tie points, and low signal detector by-pass means for disabling said low signal detector means when said motion detector means has detected motion of an approaching vehicle and during continued such detection.

34. In an apparatus for detecting a vehicle on a track, including transmitter means for transmitting a track signal in the track, receiver means receiving such track signal for responding to the character thereof upon the presence of such vehicle to indicate such vehicle, said receiver means including monitor means for monitoring such track signal, the improvement comprising:

said monitor means including a free-running AC signal generating threshold detector means for producing an AC signal when such track signal is above a predetermined magnitude and for terminating such AC signal when such track signal is below such predetermined magnitude, and further comprising track signal coupling means for coupling said transmitter means and receiver means at respective spaced apart tie points to the track defining an island therebetween, said receiver means further comprising means for producing a proportional AC signal at a magnitude proportional to the magnitude of such track signal received by said receiver means, said monitor means further comprising means for passing the AC signal component of such proportional AC signal to said threshold detector means and for blocking any DC signal component from the latter, whereby said threshold detector means will tend to produce such AC signal as long as the magnitude of such track signal causes such AC signal component of such proportional AC signal to exceed a predetermined threshold value.

35. The improvement of claim 34, further comprising adjusting means for adjusting such predetermined magnitude.

36. The improvement of claim 34, said receiver means including output means for indicating detection of such vehicle when so detected by said receiver means, and said output means including means responsive to said monitor means for producing such indication of detection when said monitor means stops producing such AC signal.

37. The improvement of claim 36, said monitor means including converting means for converting such AC signal to a DC signal and coupling means for coupling said converting means to said output means to provide such DC signal as a power signal to the latter.

38. The improvement of claim 34, said monitor means comprising low signal detector means for detecting when the magnitude of such track signal drops below a predetermined low signal level due to uncorrected track ballast conditions or the proximity of a vehicle to the tie points of the apparatus to the track.

39. The improvement of claim 38, further comprising visual indicating means for indicating proper operation of said low signal detector means.

40. The improvement of claim 39, said monitor means further comprising means for adjusting such predetermined value to one for stopping such AC signal when such vehicle is in such island and amplifier means for amplifying such AC signal component and coupling means for delivering such amplified AC signal component to said threshold detector means.

41. The improvement of claim 40, further comprising converting means for converting such AC signal to a DC signal and output means responsive to said DC signal for indicating the presence of such vehicle in such island when such DC signal terminates.

42. In an apparatus for detecting a vehicle on a track, including transmitter means for transmitting a track signal, receiver means receiving such track signal for monitoring at least one parameter thereof, and output means for producing a prescribed output in response to such parameter attaining a prescribed condition as monitored by such receiver means, the improvement comprising prolonged indicator means for indicating the attaining of such prescribed condition during the attaining of such prescribed condition and after such parameter no longer is at such condition, said receiver means comprising means for detecting a vehicle on such track in accordance with variations in such parameter caused by such vehicle, said output means comprising means for producing output information indicative of the presence of such vehicle, and further comprising coupling means for coupling said transmitter means and receiver means at spaced apart tie points to said track to define an island between said tie points and cancel means responsive to the presence of a vehicle in such island for cancelling operation of said prolonged indicator means when such vehicle enters such island, whereby upon such vehicle leaving such island, said output means terminates producing such output information indicative of such vehicle.

43. In an apparatus for detecting a train on a track, including transmitter means for producing a track signal, receiver means for receiving such track signal, coupling means for coupling said transmitter means and receiver means to such track at respective spaced-apart tie points defining an island therebetween, the improvement comprising island circuit means for producing an island signal when no train is in such island and no island signal when a train is in such island, and output means responsive to such island circuit means for producing output information indicative of whether or not a train is in such island, said island circuit means comprising a threshold detector means for producing an AC island signal when the magnitude of such track signal received by said receiver means exceeds a predetermined magnitude.

44. The improvement of claim 43, said threshold detector means comprising amplifier means receiving an AC input signal when such track signal is received by said receiver means for producing an amplified AC output signal and threshold detector means for producing an AC square wave pulse train upon receiving such AC output signal at at least a minimum magnitude.

45. The improvement of claim 44, further comprising energy conversion means for converting such square wave signal to a DC signal and output means for coupling such DC signal to effect energization and deenergization of an island relay to indicate whether or not a train is in such island.

46. The improvement of claim 44, said island circuit means further comprising potentiometer input means for setting such predetermined minimum magnitude.

47. Apparatus for detecting a vehicle on a track, comprising transmitter means for producing a track signal, receiver means for receiving such track signal, coupling means for coupling said transmitter means and receiver means at tie points to such track, said receiver means including circuit means for producing from such received track signal a characteristic signal having a magnitude capable of varying according to the proximity of a vehicle on such track to such tie points, output means responsive to a parameter of such characteristic signal for producing output information indicating the presence of a vehicle on such track, and clamp means for limiting the rise of such characteristic signal for a predetermined time in response to a vehicle leaving such tie points.

48. The apparatus of claim 47, further comprising low signal detector means for detecting when the magnitude of such characteristic signal drops below a predetermined low signal magnitude, and disabling means for disabling said clamp means when the magnitude of such characteristic information is less than such predetermined low signal magnitude.

49. The apparatus of claim 48, wherein such parameter is the downward rate of change of such characteristic signal, and said output means comprises means for sensing when such downward rate of change exceeds a predetermined value.

50. The apparatus of claims 47, 48 or 49, wherein such parameter is the downward rate of change of such characteristic signal caused by a vehicle approaching such tie points, and further comprising level control means for adjusting the gain of said receiver means in an effort to maintain the magnitude of such characteristic signal at a predetermined value, and holding means for holding such gain at a substantially constant value when the magnitude of such characteristic signal drops below a predetermined value before the motion of such vehicle has been detected.

51. The apparatus of claim 50, said level control means comprising means for adjusting the gain of both said transmitter means and receiver means.

52. Apparatus for detecting a vehicle on a track, comprising transmitter means for producing a track signal, receiver means for receiving such track signal, coupling means for coupling said transmitter means and receiver means at respective tie points to such track defining an island therebetween, said receiver means including circuit means for producing from such received track signal a characteristic signal having a magnitude capable of varying according to the proximity of a vehicle on such track to such tie points, output means responsive to a parameter of such characteristic signal for producing output information indicating the presence of a vehicle on such track, and level control means for adjusting the gain of said receiver means in an effort to maintain the magnitude of such characteristic signal at a predetermined value, and wherein such parameter is the downward rate of change of such characteristic signal in response to approaching movement of a vehicle, and said output means comprising means for sensing when such downward rate of change exceeds a predetermined value, thereby to detect the approaching motion of such vehicle, and further comprising holding means for controlling said level control means to hold such gain at a substantially constant level when the magnitude of such characteristic signal drops below a predetermined value before the motion of such approaching vehicle has been detected.

53. Apparatus for detecting a train on a track, comprising transmitter means for transmitting a track signal, receiver means for receiving such track signal, coupling means for coupling said transmitter means and receiver means at tie points to the track, output means responsive to a parameter of such received track signal for producing information indicative of whether or not a train is detected on such track, and reverse switch override means for consistently temporarily preventing said output means from producing information indicative of a detected train while at least one of said receiver means and output means stabilize when a track switch in such track is thrown to permit entry of a train onto the track in a direction away from such tie points.

54. The apparatus of claim 53, said output means comprising means for producing a predetermined output signal when no train has been detected, and said reverse switch override means comprises means for providing a substitute predetermined output signal consistently at substantially constant level for a predetermined time period for such predetermined output signal regardless of whether the latter is being produced by said output means.

55. The apparatus of claim 53, said reverse switch override means comprising temporary power supply means for supplying power during a predetermined time after the throwing of such track switch, oscillator means for producing an AC signal upon receiving power from said temporary power supply means, energy conversion means for converting such AC signal to a DC signal as such substitute predetermined output signal.

56. The apparatus of claim 53, said output means comprising delay means responsive to production of such output information indicative of a detected train for continuing production of such output information for a predetermined duration and cancel means responsive to operation of said reverse switch override means for preventing operation of said delay means while said reverse switch override means is operative to prevent said output means from producing information indicative of a detected train.

57. In an apparatus for detecting a vehicle on a track, including transmitter means for transmitting a track signal, receiver means for receiving such track signal, and including movement detector means responsive to changes in such track signal for detecting approaching motion of a vehicle on the track, low signal detector means for sensing excursions of such track signal below a predetermined low signal level, and high signal detector means for sensing excursions of such track signal above a predetermined high signal level, the improvement comprising output circuit means for producing one output signal when no approaching movement of a vehicle has been detected and the magnitude of such track signal is within a window between such high and low signal levels and a second output signal when approaching motion is detected or such track signal is outside such window, said output circuit means including circuit means for producing an AC output signal when approaching motion is not detected and a DC signal when approaching motion is detected, plural series gates connected to pass such AC output signal when such track signal is within such window and to block such AC output signal when such track signal is outside such window.

58. The improvement of claim 57, said gates including first gate means for monitoring the output from said low signal detector means and second and third gate means for monitoring outputs from said high signal detector means.

59. The improvement of claim 57, said transmitter means including AC signal generator means for generating an AC signal and modulating means for modulating such AC signal, and one of said gates comprising gate means for block such AC output signal when said modulating means is inoperative to modulate such AC signal.

60. The improvement of claim 57, said transmitter means including AC signal generator means for generating an AC signal and one of said gates including gate means for blocking an AC output signal when said generating means is inoperative to produce such first mentioned AC signal.

61. The improvement of claim 57, further comprising energy conversion means coupled to the output of said gates for producing a DC output signal upon receipt of such AC output signal and no output signal when such AC output signal is not received.

62. In a train approach detector including transmitter means for transmitting a track signal, receiver means for receiving such track signal, said receiver means including output means for producing output information indicative of detection of a train, motion detecting means for detecting a change in such track signal representative of an approaching train, coupling means for coupling said motion detecting means to said output means to cause the latter to produce such output information when said motion detecting means detects an approaching train, the improvement comprising delayed pick-up means for preventing termination of such output information caused by detection of an approaching train for a predetermined fixed time period commencing with the time at which said motion detecting means loses detection of such approaching train.

63. The improvement of claim 62, said delayed pick-up means comprising timing circuit means for timing such predetermined time period.

64. The improvement of claim 63, said delayed pick-up means further comprising decoding circuit means for decoding an input signal indicative of detection of an approaching train by said motion detecting means, said decoding circuit means including disabling means for disabling said motion detecting means from recovering upon loss of detection of an approaching train to terminate an indication of such detection.

65. In a train approach detector including transmitter means for transmitting a track signal, receiver means for receiving such track signal, said receiver means including output means for producing output information indicative of detection of a train, motion detecting means for detecting a change in such track signal representative of an approaching train, coupling means for coupling said motion detecting means to said output means to cause the latter to produce such output information when said motion detecting means detects an approaching train, the improvement comprising delayed pick-up means for preventing termination of such output information caused by detection of an approaching train for a predetermined time period commencing with the time at which said motion detecting means loses detection of such approaching train, said delayed pick-up means comprising timing circuit means for timing such predetermined time period and decoding circuit means for decoding an input signal indicative of detection of an approaching train by said motion detecting means, said decoding circuit means including disabling means for disabling said motion detecting means from recovering upon loss of detection of an approaching train to terminate an indication of such detection, and said motion detecting means comprising circuit means for producing an AC signal when no train has been detected and for terminating such AC signal upon such detection, and said disabling means comprising means for disabling said circuit means from producing such AC signal.

66. The improvement of claim 65, said circuit means comprising a flip-flop, said timing circuit means comprising a resistor capacitor charging circuit, said decoding circuit means comprising an integrated circuit, and said disabling means comprising an output connection from said integrated circuit.

67. In a train approach detector including transmitter means for transmitting a track signal, receiver means for receiving such track signal, said receiver means including output means for producing output information indicative of detection of a train, motion detecting means for detecting a change in such track signal representative of an approaching train, coupling means for coupling said motion detecting means to said output means to cause the latter to produce such output information when said motion detecting means detects an approaching train, connecting means for connecting said transmitter means and receiver means to such track at respective tie points to define an island therebetween, said receiver means including island detector means for detecting the presence of a train in such island, the improvement comprising delayed pick-up means for preventing termination of such output information caused by detection of an approaching train for a predetermined time period commencing with the time at which said motion detecting means loses detection of such approaching train, and cancel means responsive to a train entering such island for cancelling operation of such delayed pick-up means.

68. In a train approach detector including transmitter means for transmitting a track signal, receiver means for receiving such track signal, said receiver means including output means for producing output information indicative of detection of a train, motion detecting means for detecting a change in such track signal representative of an approaching train, coupling means for coupling said motion detecting means to said output means to cause the latter to produce such output information when said motion detecting means detects an approaching train, and connecting means for connecting said transmitter means and receiver means to such track at respective tie points to define an island therebetween, said receiver means including island detector means for detecting the presence of a train in such island, the improvement comprising delayed pick-up means for preventing termination of such output information caused by detection of an approaching train for a predetermined time period commencing with the time at which said motion detecting means loses detection of such approaching train, cancel means responsive to a train entering such island for cancelling operation of such delayed pick-up means, said cancel means comprising timing circuit means responsive to a train leaving such island for producing a cancel signal for a further predetermined time period that is longer than such predetermined time period of said delayed pick-up means, thereby to permit termination of such output information promptly after a train leaves the island.

69. A train approach detector, comprising transmitter means for transmitting a track signal in a track, receiver means for receiving such track signal, said receiver means including monitor means for monitoring at least one parameter of such track signal and output means for indicating such a train in response to a predetermined condition of such parameter occurring in such track signal, and reverse switch override control means for consistently temporarily overriding an indication of a train by said output means when a track switch is thrown at least temporarily causing such predetermined condition of such parameter to occur.

70. The apparatus of claim 69, said reverse switch override control means comprising timing circuit means for producing a power signal for a predetermined time period upon such throwing of such track switch, oscillator means for producing an AC signal while receiving such power signal, and output circuit means for delivering an override signal to override such output indication while receiving such AC signal.

71. The apparatus of claim 70, said output means comprising means for delivering an output signal to energize a relay when no train is detected, said output means normally de-energizing such relay when a train has been detected, and said output circuit means comprising means for delivering such override signal as a substitute for said output signal to maintain energization of such relay.

72. The apparatus of claim 69, said monitor means comprising motion detector means for detecting changes in such track signal representative of the motion of an aproaching train on the track, said output means being operative to indicate such approaching train upon detection thereof by said motion detector means, and further comprising delayed pick-up means for delaying termination of such indication for a predetermined time period, and said reverse switch override control means comprising cancel means for cancelling any such predetermined time period on said delayed pick-up means upon the throwing of such track switch.

73. The apparatus of claim 72, wherein a change occurs in the track signal upon the throwing of a track switch to cause said motion detector means to operate as though detecting a train so as also to initiate a predetermined time period of said delayed pick-up means, and wherein said delayed pick-up means includes charging circuit means for determining such predetermined time period and wherein said reverse switch override control means comprises a capacitor discharge timing circuit means for producing a power signal to operate said reverse switch override control means for a further predetermined time period, and said cancel means comprising circuit means for promptly charging said charging circuit means well prior to the end of such further predetermined time period.

74. A detector for detecting an approaching vehicle on a track, comprising transmitter means for transmitting a detectable signal capable of attenuation by an approaching vehicle, and receiver means for monitoring changes in the magnitude of such detectable signal, including energy storage means for storing energy in proportion to the magnitude of such detectable signal received by said receiver means, comparison means for comparing the signal value at an output of said energy storage means with an AC comparison signal to produce a first output signal when the energy stored in said energy storage means changes in one polarity direction, which represents a receding vehicle, or remains at a substantially constant energy level, which represents no detected vehicle on the track, and a second output signal when the energy stored in said energy storage means changes in an opposite direction, which represents detection of an approaching vehicle on the track.

75. The detector of claim 74, further comprising adjusting means for adjusting the magnitude of the rate of change in such opposite direction necessary for said comparison means to produce such second output signal.

76. The detector of claim 74, said energy storage means comprising a capacitor.

77. The detector of claim 74, further comprising input means for facilitating storage of energy in said energy storage means in such one polarity direction.

78. The detector of claim 77, said energy storage means comprising a capacitor, and said input means comprising a rectifier.

79. The detector of claim 74, said energy storage means comprising a capacitor having an input to receive a DC signal and an output, a capacitive circuit coupled between said input and a source of reference potential, and rectifier circuit means coupled between said output and a source of reference potential for facilitating expeditious charging of said capacitor in such one polarity direction.

80. The detector of claim 79, further comprising means for coupling said rectifier circuit means and said capacitive circuit to a common source of reference potential.

81. The detector of claim 79, said comparison means comprising amplifier means for producing an AC output signal when said capacitor charges or remains at a substantially constant charged level and for producing a DC output signal when said capacitor discharges at a predetermined rate.

82. The detector of claim 79, said comparison means comprising amplifier means or producing an AC output signal when said capacitor charges or remains at a substantially constant charged level and for producing a DC output signal when said capacitor tries to discharge at a predetermined rate.

83. In an apparatus for detecting a vehicle on a track, including transmitter means for transmitting a track signal and receiver means for receiving such track signal for monitoring a parameter thereof, said receiver means including output means for producing an output indicative of the excursion of such monitored parameter beyond at least one of predetermined limits, the improvement comprising:

checking means for checking the correct operation of at least one portion of at least one of said transmitter means and receiver means while combining such checking function with such monitoring of such parameter function, said checking means including pulse train means for delivering as an output therefrom a pulse train when such one portion is properly operating and such parameter is within such limits, overriding means for overriding effective delivery of such pulse train when at least one of such portion is not properly operating and such parameter is beyond one of such limits, and meter means for displaying the values of electrical signals delivered thereto and switch means for selectively connecting respective electrical signals occurring in the apparatus to said meter means for display thereby.

84. The apparatus of claims 26, 47 or 53, further comprising meter means for displaying the values of electrical signals delivered thereto and switch means for selectively connecting respective electrical signals occurring in the apparatus to said meter means for display thereby.

85. The apparatus of claim 69, further comprising meter means for displaying the values of electrical signals delivered thereto and switch means for selectively connecting respective electrical signals occurring in the detector to said meter means for display thereby.

86. The apparatus of claim 83 further comprising meter means for displaying the values of electrical signals delivered thereto and switch means for selectively connecting respective electrical signals occurring in the apparatus or detector to said meter means for display thereby.

87. Apparatus for detecting a vehicle on a track, comprising transmitter means for transmitting an AC track signal in the track, receiver means for receiving such track signal, including detector means for monitoring a parameter of such track signal representative of such vehicle, and output means responsive to such detection of such a vehicle by said detector means for producing output information indicative of such vehicle on such track, said receiver means including converting means for converting such received track signal to a substantially DC signal value with ripple pulses impressed thereon, and sensing means for sensing such ripple pulses as a function of whether or not such track signal is received by said receiver means, said sensing means comprising amplifier means for amplifying such ripple pulses and trigger means for producing a square wave pulse train in response to receipt of such amplified ripple pulses, such ripple pulses comprising an AC signal at one frequency with a higher frequency AC ripple signal impressed thereon, said amplifier means having inverting and non-inverting inputs and an output, gain circuit means connected to said output, to one of said inputs and to a source of reference potential for determining the gain of said amplifier means, such ripple pulses normally being applied to the other of said inputs, and filter means coupled to said gain circuit means for limiting the frequency response of said amplifier means to pass such AC signal while blocking at least a substantial portion of such AC ripple signal.

88. Apparatus for detecting a vehicle on a track, comprising transmitter means for transmitting an AC track signal in the track, receiver means for receiving such track signal, including detector means for monitoring a parameter of such track signal representative of such vehicle, and output means responsive to such detection of such a vehicle by said detector means for producing output information indicative of such vehicle on such track, pulse train producing means for producing a pulse train indicative of a proper form of such AC track signal being produced by said transmitter means, said receiver means including converting means for converting such received track signal to a substantially DC signal value with ripple pulses impressed thereon, and sensing means for sensing such ripple pulses as a function of whethr or not such track signal is received by said receiver means, said sensing means comprising amplifier means for amplifying such ripple pulses and trigger means for producing a square wave pulse train in response to receipt of such amplified ripple pulses, said output means comprising combining means for combining information from said sensing means and such pulse train to enable said output means when both such track signal is received and such other pulse train is produced and when either or both are not received or produced to disable said output means, said combining means comprising flip-flop means for producing an enabling signal for said output means when both said pulse train and said square wave pulse train are received by said flip-flop means, such ripple pulses comprising an AC signal at one frequency with a higher frequency AC ripple signal impressed thereon, said amplifier means having inverting and non-inverting inputs and an output, gain circuit means connected to said output, to one of said inputs and to a source of reference potential for determining the gain of said amplifier means, such ripple pulses normally being applied to the other of said inputs, and filter means coupled to said gain circuit means for limiting the frequency response of said amplifier means to pass such AC signal while blocking at least a substantial portion of such AC ripple signal.

* * * * *